US005114271A

United States Patent [19]

Sunderhaus et al.

[11] Patent Number: 5,114,271

[45] Date of Patent: May 19, 1992

[54] SPILL CONTAINMENT DEVICES

[75] Inventors: Charles A. Sunderhaus, Hamilton; Paul B. Anderson, Cincinnati, both of Ohio

[73] Assignee: Dover Corporation, New York, N.Y.

[21] Appl. No.: 592,132

[22] Filed: Oct. 3, 1990

[51] Int. Cl.[5] ..... B65G 5/00; B65B 3/06

[52] U.S. Cl. ..... 405/52; 141/86; 404/25

[58] Field of Search ..... 405/52, 53, 128, 129; 52/20; 137/312, 371; 141/86; 220/18, 85 F, 86 R; 222/108; 404/25

[56] References Cited

U.S. PATENT DOCUMENTS

| | | | |
|---|---|---|---|
| 3,975,870 | 8/1976 | Naka | 52/20 |
| 4,456,397 | 6/1984 | Freis et al. | 404/25 |
| 4,659,251 | 4/1987 | Petter et al. | 405/52 |
| 4,793,387 | 12/1988 | LeBlanc et al. | 141/86 |
| 4,807,675 | 2/1989 | Sharp | 141/86 |
| 4,842,443 | 6/1989 | Argandona | 405/52 |
| 4,896,705 | 1/1990 | Podgers et al. | 141/86 |
| 4,958,957 | 9/1990 | Berg et al. | 405/52 X |
| 4,960,346 | 10/1990 | Tamayo | 405/52 |

*Primary Examiner*—David H. Corbin
*Attorney, Agent, or Firm*—Kinney & Schenk

[57] ABSTRACT

A containment device for minimizing soil contamination in filling underground storage tanks, comprises a bucket member, a bottom member and a bellows connection between the bottom member and a riser pipe extension. These elements comprise an upwardly open spillage container. A lower bellows connects the bottom member and the riser pipe extension, comprising a lower chamber. The containment device is mounted on the riser pipe of an underground tank by threading the lower end of the riser pipe extension thereon. A valve controlled passage, through the bottom member, permits spilled fuel to be drained from the spillage container into the lower chamber and then through openings in the riser pipe extension into the storage tank. The bottom member is releasably secured to the bucket member and the bellows are releasably clamped to the riser pipe extension, to permit these items to be removed from the bucket member for repair and replacement. In an alternate embodiment there is no lower chamber and the upper bellows is releasable clamped directly to a storage tank riser pipe. In another embodiment the upper and lower bellows are formed as portions of an elastomeric separating member. In order to control the installed orientation of the bucket, adjustable mechanism is provided for establishing a desired position of the upper end of the bucket member relative to the riser pipe extension. Also described is a bayonet connection between the bucket member and a mounting rim; a dam arrangement from preventing ground water from entering the spillage container; and wire anchors for insuring a firm connection between the containment device rim and a concrete apron which overlies the storage tank.

55 Claims, 12 Drawing Sheets 20
20

250
248
20D
243
246
249
242
241
240
150
X
Y
236
80D
238
86D
86D
232
60D
54
36D
230
234
34D
90D
94D
94D
151D
148D
24D
162
38D
66D
64D
70D
68D
26
32

SPILL CONTAINMENT DEVICES

The present invention relates to spill containment devices employed in minimizing pollution in the delivery of fuels and other liquids to an underground storage tank.

In recent years there has been an increasing appreciation of the harmful environmental affects resulting from spilling of fuel into the soil. One source of such soil contamination is found in the transfer of fuel from delivery trucks to underground storage tanks, as are employed in gasoline service stations. In transferring fuel, a connection must be made between a relatively large hose and a riser pipe which projects upwardly from the storage tank. Normally, the riser pipe connection is disposed below ground level and accessed by removing a lid from a manhole opening wherein the riser pipe terminates.

Despite taking precautions thereagainst, there is, almost always, some spillage of fuel either when the hose is connected to or disconnected from the riser pipe. Further, accidents can and do occur which result in substantial quantities of fuel spilling during the transfer process. In the past the spilled fuel has simply been allowed to pass into the subsoil, resulting in contamination which has several adverse affects. Now that the hazards of soil contamination have been recognized, many jurisdictions now have regulations which require that such spills be contained.

The need for eliminating this source of soil contamination is recognized by several proposals in the patent literature, several of which, known as spill containment devices, have found commercial acceptance. U.S. Pat. Nos. 4,659,251—Petter, et al., 4,696,330—Raudman, et al., 4,763,806—Podgers et al. are exemplary. These devices, generally, comprise a rim structure which is mounted in a concrete apron and defines the upper end of a an upwardly open spillage container, sometimes referenced as a bucket or sump. A riser pipe, extending from an underlying storage tank, projects through the bottom of the bucket and terminates below the level of the rim, within the interior of the bucket. A sealed connection is provided between the bottom of the bucket and the riser pipe so that any fuel spilled, when the storage tank is filled with fuel, will be contained within the bucket and not flow into the subsoil. While proposals vary, provision is usually made to selectively discharge fuel, spilled into the bucket, into the riser pipe and thus into the storage tank.

One of the problems encountered in providing such spill containment devices is that there is a likelihood, if not a certainty, that, after installation, there will be relative movement between the rim structure, which is usually anchored in a concrete apron at ground level, and the riser pipe which is connected to the storage tank several feet below ground. This relative movement, usually associated with frost heaving, has the potential of causing loss of the sealed connection between the riser pipe and the bottom of the bucket.

This problem has been recognized and several proposals made to prevent loss of the sealed connection between the bottom of the bucket and the riser pipe when there is relative movement therebetween, in either a vertical or lateral direction. Several of these proposals are based on the uses of bellows, which, in one fashion of another are interposed between the riser pipe and the rim structure which is anchored in the concrete apron. Generally speaking the use of bellows has been found to be an effective means for accommodating this relative movement.

One shortcoming found in prior art containment devices is that they are difficult to maintain. This is to say that leaks can develop over a period of time. For example, the referenced bellows are formed of an elastomeric material which, over a prolonged period, can deteriorate to the extent that leaks are created as the bellows are flexed. Also, through abuse, such bellows can be punctured or otherwise develop a leak, to the end that spilled fuel is no longer contained in the bucket. Thus these bellows, or their equivalents, or other components employed in obtaining the desired seal, require both inspection and replacement as a normal maintenance function of the spill containment device.

Accordingly, one object of the present invention is to improve the maintenance capabilities of spill containment devices.

Another function provided by a bellows, or other flexible, sealed connection between a riser pipe and the bottom of a containment device bucket is to facilitate construction of a storage tank loading area at a service station. Installation of a storage tank, riser pipe and an overlying concrete apron is far from a precision procedure. The general procedure, in an original installation, is to first place a storage tank in an excavation with the riser pipe mounted thereon. The depth of the excavation, and the length of the riser pipe are predetermined to bring the top of the riser pipe to a given relationship with the surface of the concrete apron, which is to be poured after the containment device is mounted on the riser pipe, and the excavation back filled. Seldom is the containment device at the desired height. This is particularly true where several storage tanks and containment devices are to be associated with a common concrete apron and the containment devices are, desirably, to be at the same height. The situation is further aggravated in that a riser pipe will not necessarily be plumb, requiring the containment device to be angled relative to the riser pipe to bring the rim structure thereof to a desired horizontal position.

While prior containment devices, employing such bellows, or other flexible connections, have the capability of being adjusted to properly align the rim structure thereof, the process if tedious and time consuming.

Accordingly, a further object of the present invention is to facilitate the installation of spill containment devices.

Further objects of the invention are found in providing an improved connection with the metal rim which supports a lid for the spillage container; minimizing, if not eliminating, flow of ground water into the spillage container; and improving the connection between the spill container rim and the concrete apron on which it is mounted.

In accordance with one aspect of the invention, the foregoing ends are broadly attained by a containment device comprising a bucket member in the form of a vertically disposed shell and a riser pipe extension adapted to be mounted on a storage tank riser pipe and comprising riser pipe means. A bottom member is secured in fixed, assembled relation to the bucket and has an opening through which the riser pipe extension projects in spaced relation thereto.

The riser pipe extension has an upper end portion above the bottom member and a lower end portion disposed beneath the bottom member. An upper flexible member, preferably in the form of a bellows, extends between the bottom member and the upper portion of riser pipe extension to provide for relative movement between the bucket member and the riser pipe means. The bucket member, bottom member and upper flexible member define an upwardly open, spillage container.

A lower, flexible member extends between the bottom member and the lower portion of the riser pipe extension and defines, at least in part, a lower chamber beneath the spillage container.

Preferably, means are provided for draining fuel from the spillage container to the lower chamber and then into the lower portion of the riser pipe extension through openings formed therein. The draining means, preferably, include a passageway extending through the bottom member and a selectively actuable valve for controlling fuel flow through this passageway.

In a preferred form, the bottom member is a generally planar annulus and the opening for the riser pipe extension is defined by an upstanding annular flange. The lower end of upper bellows is clamped to the upstanding flange and its upper end is clamped to the upper portion of the riser pipe extension. The bottom member also has a depending annular flange and the bellows has an upper end sealingly clamped to the depending flange and a lower end clamped to the lower portion of the riser pipe extension. The diameter of the depending, bottom member flange is substantially greater than opening defining flange, with the drain opening is disposed between the flanges.

The connections of the bellows to the riser pipe extension and the connection of the bottom member to the bucket member are releasable to permit removal of these items for repair and/or replacement.

The preferred connection between the bucket member and bottom member comprises vertical slots in the bucket member and lugs projecting from the bottom member and seating on the bottoms of the slots. A circumferential groove is formed in the bucket member, above the bottoms of the slots and receives a manually removable snap ring which overlies the bottom member lugs.

In another embodiment of the invention, a single elastomeric separating member comprises portions which function as the upper bellows, bottom member and lower bellows.

In accordance with another aspect of the invention, the above stated ends are attained by a device comprising a bucket member in the form of a vertically disposed shell and a bottom member having a fixed assembled relation. The bottom member has an opening through which the riser pipe means projects. A flexible member, preferably in the form of a bellows, is secured to the bottom member and has an opening, which defines means adapted to be sealingly secured to riser pipe means to define a spillage container, in combination with the bucket and bottom members, and to provide for relative movement between the bucket member and the riser pipe means.

The bottom member is capable of being telescoped through the upper end of the bucket member to and from its assembled relation. Releasable means lock the bottom member in its assembled relation. Releasable means are provided for clamping the opening defining means of the flexible member to the riser pipe means, whereby the bottom member and bellows may be separately removed from the bottom member for repair or replacement.

In accordance with another aspect of the invention, the foregoing ends may be attained by a containment device comprising bucket means comprising a vertically disposed shell; bottom forming means defining an upwardly open, spillage container in combination with the bucket means; means attaching the bottom forming means to the riser pipe means of a storage tank and means permitting relative movement between the upper end of the bucket means and the attaching means.

Adjustable means are provided for establishing the relative relationship between the upper end of the bucket and the attaching means. Additionally, the means for establishing the relationship between the upper end of the bucket means and the attaching means are disengageable. This structure enables the bottom forming member to be attached to the riser pipe means; the top of the bucket means to be brought to a desired position; the top of the bucket secured in place in the installation process, and then the adjusting means disengaged to permit relative movement to occur as may be occasioned by natural forces.

In accordance with another aspect of the invention, the above stated objects of the invention are attained by a containment device comprising means forming an upwardly open, spillage container, the upper end of which is a shell with a generally circular outline. An annular rim telescoped over and mounted on this shell.

Mounting of the rim is accomplished through the provision of L-shaped grooves on the shell which are open at the upper end thereof. The rim has inwardly projecting lugs which are receivable in the L-shaped slots, permitting the rim to be telescoped over and then rotated with respect to the shell to bring the lugs into the horizontal portions of the L-shaped slots, thereby locking the rim thereon. Clips may then be provided in the vertical portions of the L-shaped grooves to prevent rotation which would permit inadvertent alignment of the lugs with the vertical portions of the L-shaped grooves.

The rim supports a lid which closes the opening into the spillage container. In order to minimize, if not fully prevent ground water from entering the spillage container, the upper surface of the rim is spaced beneath the upper end of the circular shell and is angled downwardly towards its outer periphery. An annular rib projects upwardly from the upper surface of the rim. The lid has a peripheral lip which engages the upper surface of the rim outwardly of the rib and supports the lid thereon.

The circular shell may have an outwardly projecting shoulder providing support for the rim and aligning it at right angles to the shell. Additionally, a sealing ring may be disposed between this shoulder and the rim. Also, the shell may further comprise a lower cylindrical section defining the outer bounds of the shoulder. The rim then comprises a depending flange telescoped over the lower cylindrical section to be aligned thereby.

As previously indicated, the containment device rim is embedded in a concrete apron. In order to more securely lock the rim into this apron, a plurality of anchors may be mounted on the rim. Each anchor is formed of metal wire and comprises a pair of downwardly angled legs connected by a central coil. Preferably the rim has lugs disposed beneath its upper surface and the anchors are, respectively, mounted on the lugs, with the coil of each anchor being expanded to yielding grip the lug on which it is mounted.

A further problem arises in the installation of containment devices of the type which provide a bellows connection to accommodate relative movement between a bucket member and riser pipe means. Such containment devices are mounted on the riser pipe means which are accessible prior to backfilling the excavation for the storage tank. Where the bucket member is open at its lower end, backfill material can work its way upwardly and thus has the potential for damaging the bellows.

In the past, various makeshift means have been employed, with limited success, to provide a barrier for preventing backfill material from entering the bottom of the bucket member.

Accordingly, yet another object of the present invention is provide protection for such bellows connections.

This end may be attained by a method for installing containment device on a riser pipe means projecting upwardly from an underground storage tank, where the containment device comprises a bucket member which is open at its lower end and bellows means are disposed in the lower end of the bucket member to accommodate relative movement between the bucket member and the riser means. The method includes the step of backfilling an excavation in which the containment device is disposed and is characterized by the step of securing an open ended bag, at one end, to the lower end of the bucket member and securing the bag, at the other end thereof, to the riser pipe means. The securing step is performed prior to backfilling to thereby protect the bellows means from backfill material.

This end may also be attained by a containment device of the type just described, which is characterized by a circumferential groove formed in the bucket member, adjacent the lower end thereof. The groove facilitates attachment of the one end of the open ended bag thereto.

The above and other related objects and features of the invention will be apparent from a reading of the following description of embodiments thereof, with reference to the accompanying drawings, and the novelty thereof pointed out in the appended claims.

In the drawings:

FIG. 18 is an elevation, in section, of a further alternate embodiment of the invention;

Figure 1:
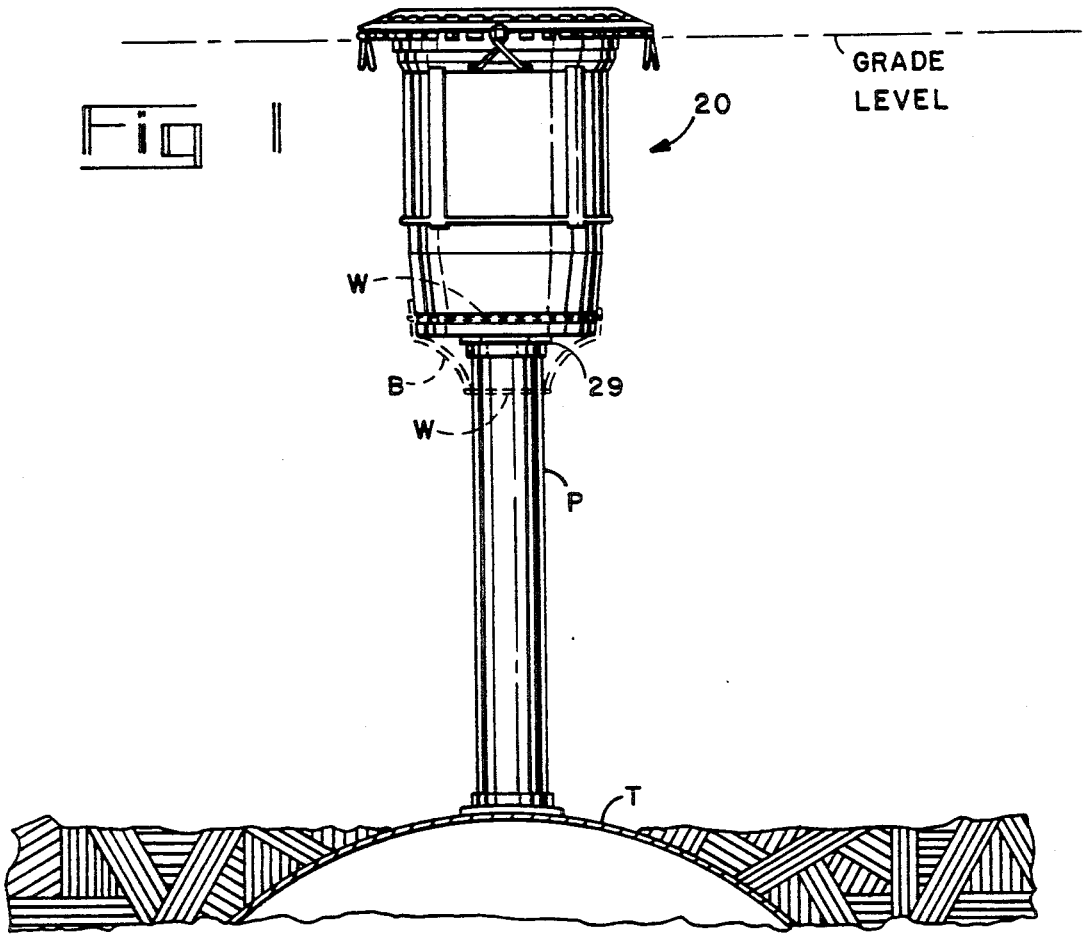
FIGS. 1 and 2 illustrate the manner in which the present spill containment device is installed.
Figure 2:
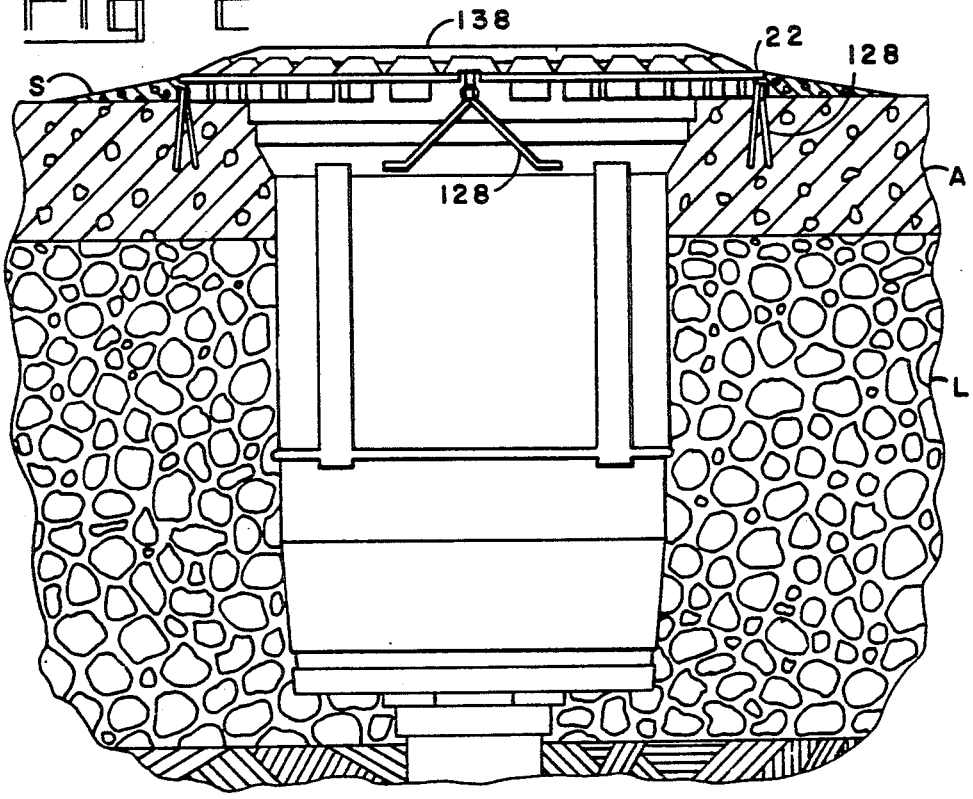

As indicated above, spill containment devices are employed to capture fuel which may be spilled in the process of being transferred from a delivery truck to an underground storage tank. FIGS. 1 and 2 illustrate the initial installation of the present spill containment device, which is generally indicated by reference character 20.

FIG. 1 shows the upper portion of a tank T which has been placed in an excavation, with soil backfilled to the upper portion thereof. A riser pipe P is mounted on the tank T and projects thereabove. The containment device 20 is then mounted on the upper end of the riser pipe P by means described below.

After the containment device 20 is mounted on the riser pipe P, the excavation may be further backfilled and a layer L, of gravel, provided to a level approximately six to eight inches below a rim 22, at the upper end of the containment device 20. Next a layer of concrete, commonly referenced as an apron and identified be reference character A is poured over the backfilled layer L. It is a preferred practice to bring the upper surface of the apron A to a level at or slightly above the lower surface of the rim 22. Concrete is then troweled around the rim to form a conical drain surface S which diverts surface water away form the opening into the containment device 20.

Figure 3:
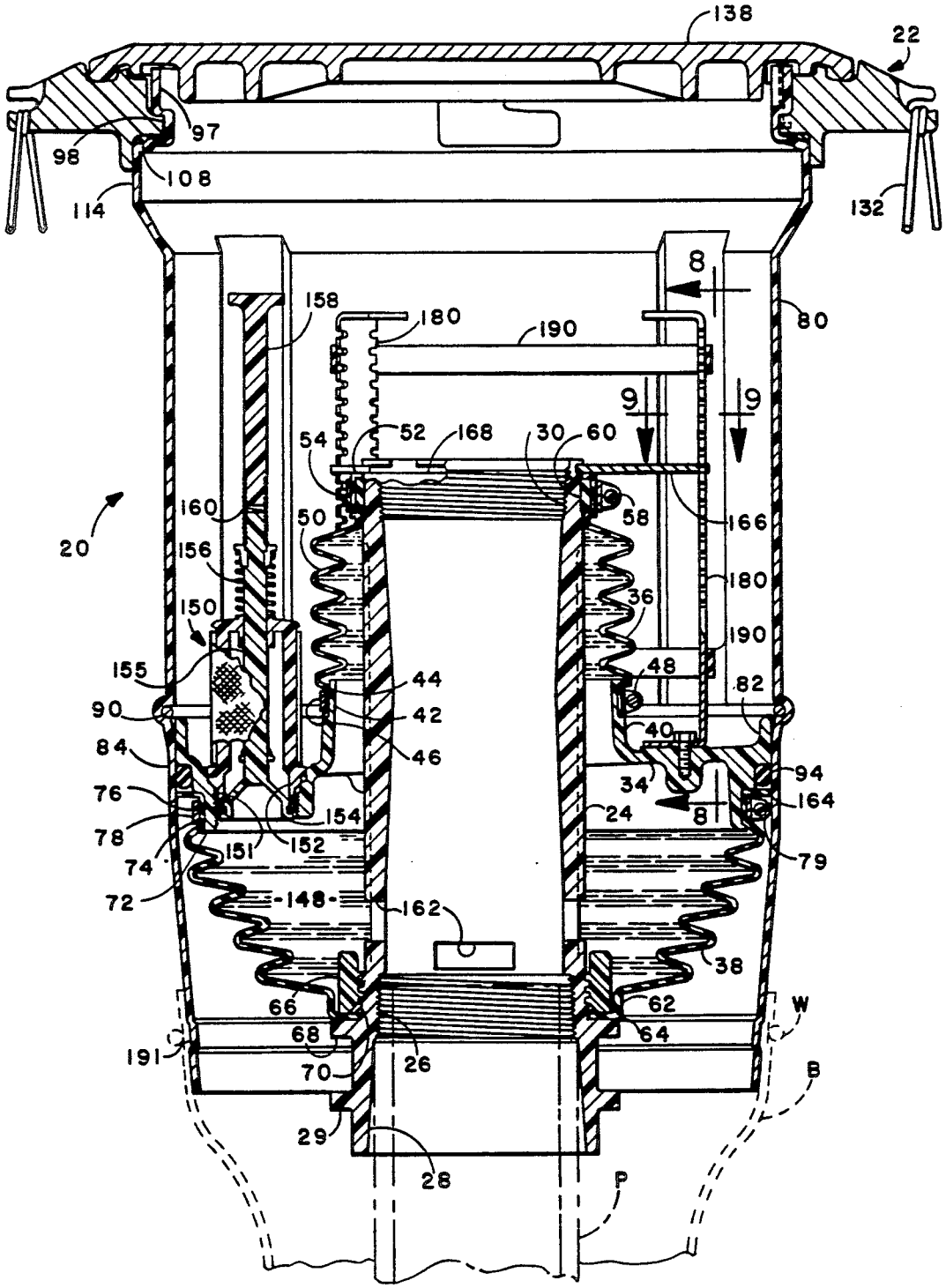
FIG. 3 is an elevation, in section and on an enlarged scale, of the spill containment device seen in FIGS. 1 and 2.
Figure 4:
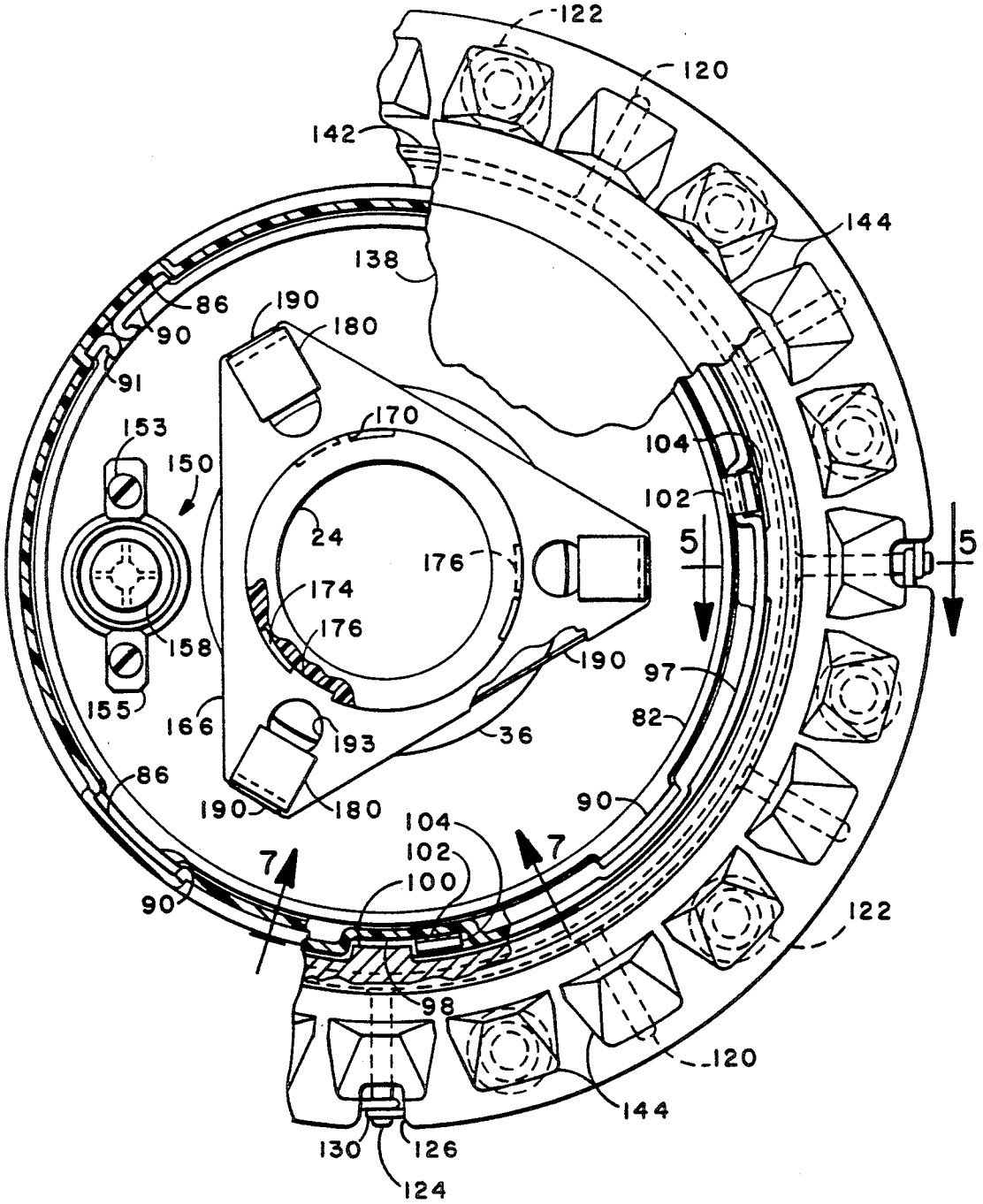
FIG. 4 is a plan view of the spill containment device, as shown in FIG. 3, with various portions broken away and in section.
Figure 5:
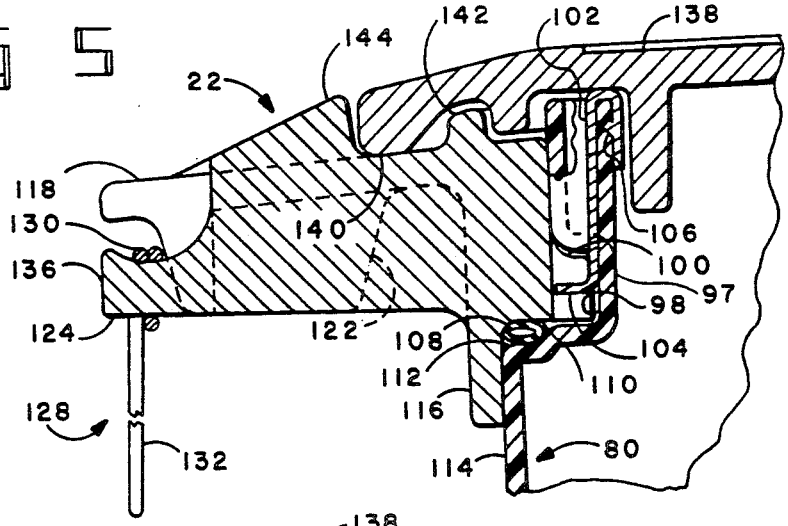
FIG. 5 is a fragmentary, vertical section, on an enlarged scale, of the upper end portion of the spill containment device, taken on line 5—5 in FIG. 4.
Figure 6:
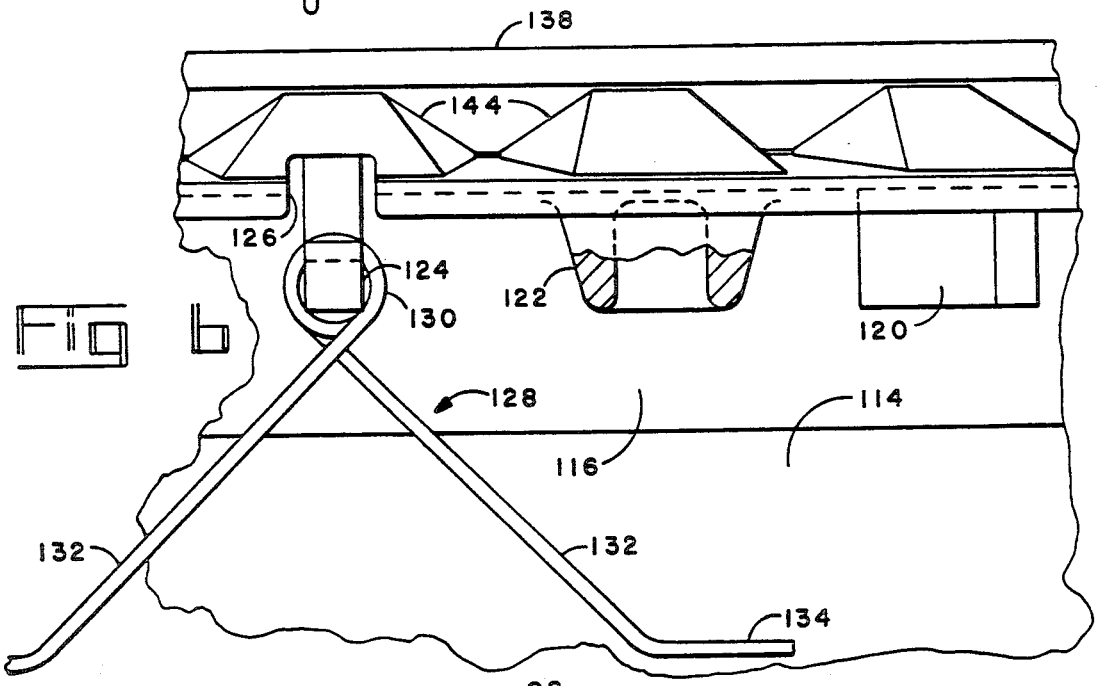
FIG. 6 is an elevation of the upper end portion seen in FIG. 5.
Figure 7:
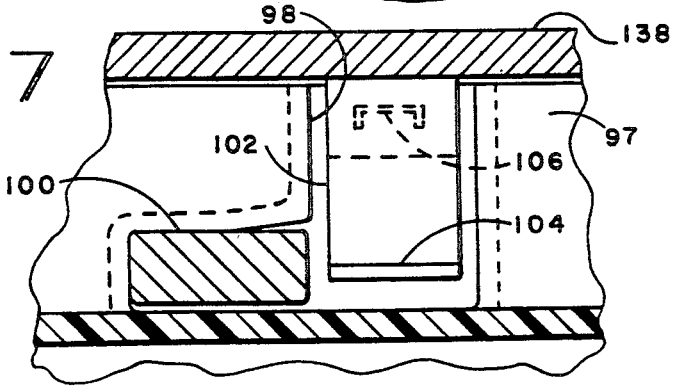
FIG. 7 is a section, on an enlarged scale, taken on line 7—7 in FIG. 4.
Figure 8:
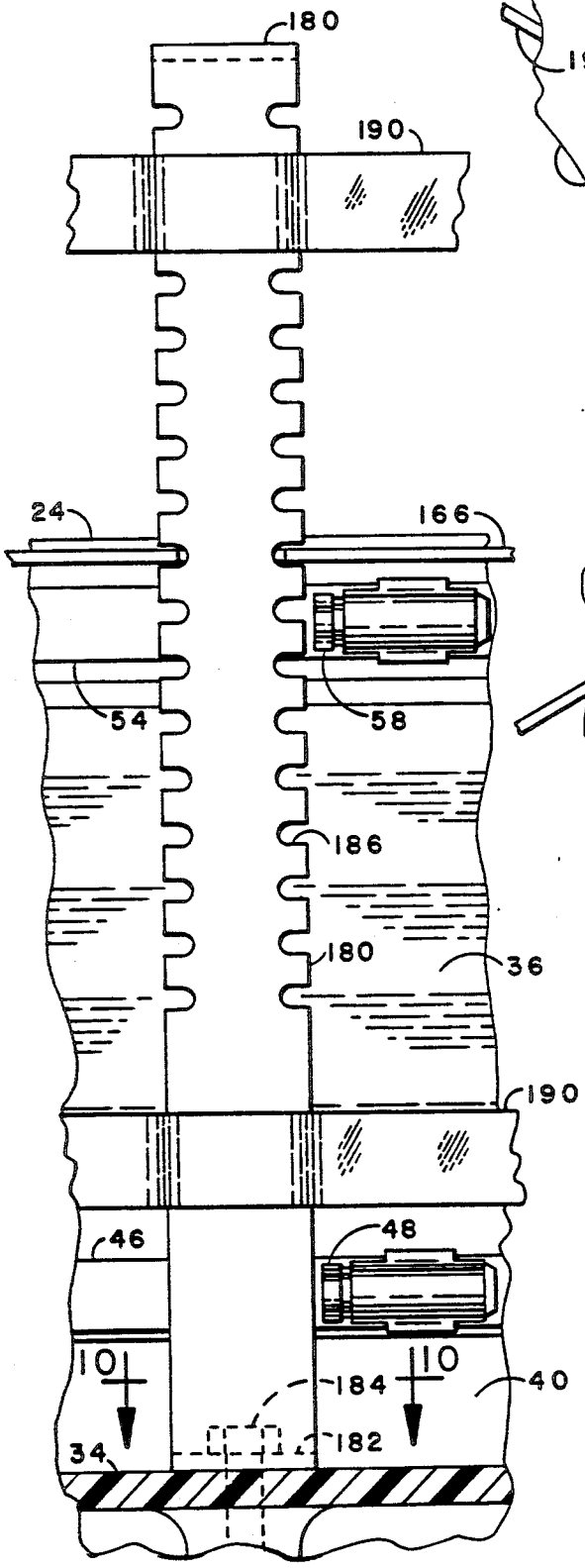
FIG. 8 is section, on an enlarged scale, taken on line 8—8 in FIG. 3.

Reference is next made to FIGS. 3 and 4 for a description of the containment device 20.

The device 20 comprises a central, riser pipe extension 24, the lower end of which is threaded onto the riser pipe P, when the device is installed. It is to be noted that the pipe threaded portion 26, which provides for mounting the riser pipe extension 24, is spaced inwardly from its lower end, and that a guide bore 28, tapered at a low angle, is provided to bring the riser pipe extension 24 into alignment with the riser pipe P during mounting of the containment device 20 thereon. The guide bore 28 facilitates proper engagement of the threaded portion 26 with the threads on riser pipe P.

It will be seen that a hex shaped flange 29 is provided adjacent the lower end of the riser pipe extension 24. The hex flange 29 (See also FIG. 1) is adapted to be received by a wrench and provide means for torquing the riser pipe extension 24 into secure engagement with the riser pipe P.

A female pipe threaded portion 30 is provided at the upper end of the riser pipe extension 24 and is adapted to receive an adapter, or other means, (not shown in FIG. 3) which will enable a fuel delivery hose to be attached thereto.

The riser pipe extension 24 is preferably formed of a synthetic resinous material to minimize the weight of the containment device. It is also preferable that a this resinous material, commonly referred to as a "plastic", be electrically conductive so that the containment device may be grounded at its connection with the delivery hose. Nylon is a suitable material for this and other structural components herein.

While resinous materials have the necessary strength for the purposes served by the riser pipe extension 24, extreme pressures can be encountered in threading the metal riser pipe P into the threaded portion 26, or a metal adaptor into the threaded portion 30. Of particular concern is damage to the threads by cross threading, where proper alignment is not obtained between the threaded components. To minimize damage to these resinous material threads, the initial portions thereof are formed by metal coils 32 (FIG. 11).

The riser pipe extension 24 is flexibly and resiliently mounted on a base member 34 (also referenced as a bottom member herein) by an upper bellows 36 and a lower bellows 38 and comprises, in combination therewith, a sub-assembly which facilitates initial testing of the bellows seals, as is later detailed. The base member 34 has an annular flange 40 projecting upwardly therefrom and defining a central opening 42 which is nominally coaxial of and spaced from the riser pipe extension 24. The bellows 36 is provided with an annular mounting sleeve 44, at its lower end which is telescoped over the upper end of the flange 40. A band clamp 46, having worm type adjusting means 48, is tightened against the bellows sleeve 44 to secure the bellows 36 to the flange 40 and provide a liquid seal between the bellows 36 and the base member 34.

Figure 11:
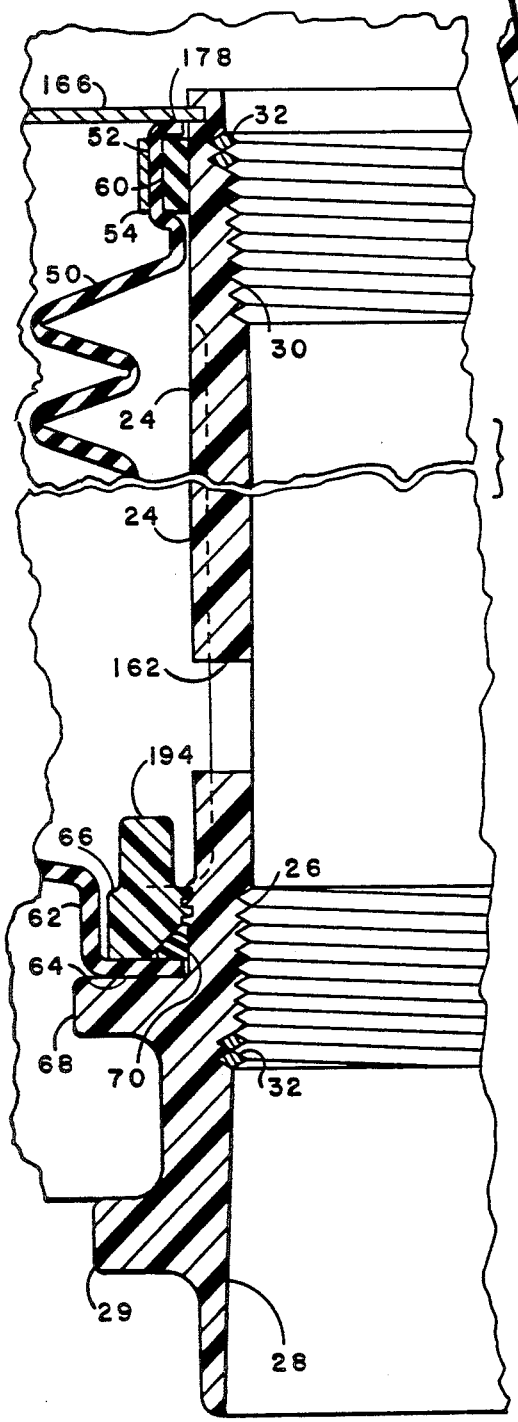
FIG. 11 is a view, on an enlarged scale, of upper and lower portions of a riser pipe extension seen in FIG. 3.

The upper fold 50 of the bellows 36 projects inwardly towards the riser pipe extension 24 and has an annular mounting sleeve 52 formed thereon (See also FIG. 11). A band clamp 54, having a worm type adjusting means 58, clamps the sleeve 52 against an annular seal 60 which is telescoped over the upper end of the riser pipe extension 24. The upper end of the bellows 36 is thus clamped, in sealing engagement with the upper end of the riser pipe extension 24.

The lower end of the lower bellows 38 is secured to the riser pipe extension 24. The lower fold of the bellows 38 extends inwardly and has a cylindrical portion 62 (See also FIG. 11) terminating in an inwardly projecting flange 64. A large ring nut 66 is threaded onto the riser pipe extension 24 and clamps the bellows flange 64 against an underlying flange 68, which projects outwardly from the riser pipe extension 24. The ring nut 66 also clamps an O-ring seal 70 into sealing engagement with the riser pipe extension 24 and the bellows flange 64. The lower end of the lower bellows 38 is thus releasably secured to the riser pipe extension 24 in sealing engagement therewith.

The lower bellows 38 flares upwardly and outwardly to the base member 34. The base member 34 has a depending flange 72 which provides a cylindrical surface 74 (See also FIG. 13) over which a cylindrical sleeve 76, at the upper end of the lower bellows 38, is telescoped. A band clamp 78, provided with a worm type adjusting means 79, secures the cylindrical sleeve 76 to the flange 72. The upper end of the lower bellows 38 is thus secured to the base member 34 in sealing engagement therewith.

Figure 12:
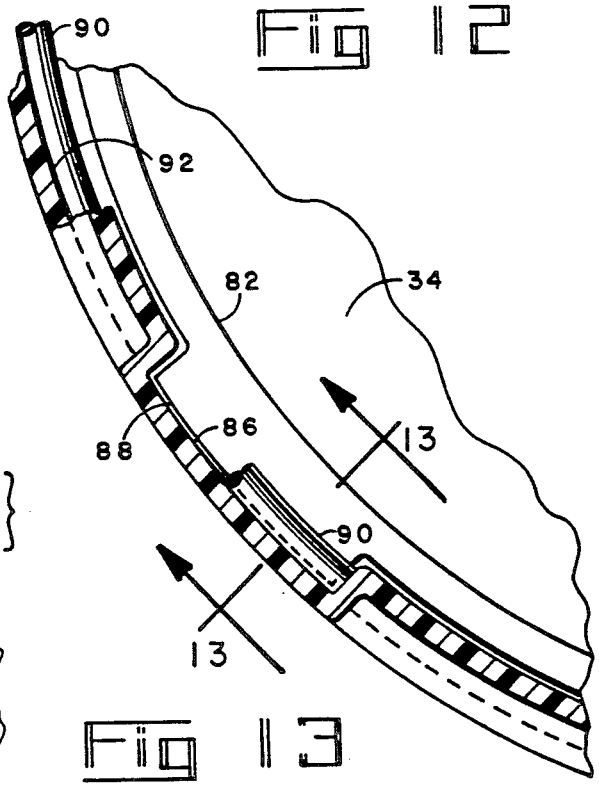
FIG. 12 is a view, on an enlarged scale and with portions broken away and in section, of a portion of a bucket member seen in FIG. 4.
Figure 13:
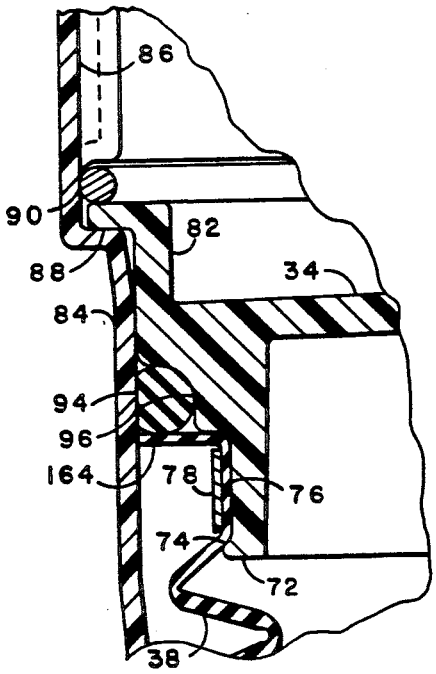
FIG. 13 is a section taken on line 13—13 in FIG. 12.

The base member 34 is removably mounted on a cylindrical, open ended, bucket member 80. To this end, the base member 34 has an upstanding rim 82 at its outer periphery, the outer surface of which is telescopingly received in a cylindrical, central portion 84 of the bucket 80. A plurality of upwardly open, vertical grooves 86 are formed in the bucket 80 (FIGS. 4, 12 and 13). The base member rim 82 has a plurality of outwardly projecting lugs 88 which are received in the grooves 86 and are supported by the bottom ends thereof. A retaining ring 90 overlies the lugs 88 and is received in a circumferential groove 92 formed in the bucket 80. The base member 34 is thus mechanically locked in assembled relation with respect to the bucket member 80.

A liquid seal is provided between the base member 34 and the bucket 80 by a sealing ring 94 which is compressed between an annular seat 96 formed on the base member and the inner surface of the cylindrical bucket section 84. The inner surface of the bucket 80, immediately above the section 84, is flared outwardly to assist in compressing the sealing ring 94 when the base member is displaced downwardly to its illustrated, assembled position.

Where resinous materials are employed to fabricate the bucket 80, there is the possibility that the resinous material will "relax" and expand in diameter so that an effective seal will not be obtained between the sealing ring 94 and the cylindrical section 84. Should this occur, provision is made for the application of a hoop ring R to reduce the diameter of this section. To this end, the lower end portion of the bucket 80 is tapered inwardly to facilitate telescoping of the hoop ring R thereover.

The rim 22 is mounted on the bucket 80 by a bayonet arrangement now to be described. The upper end of the bucket 80 comprises a generally cylindrical shell section 97 having inwardly projecting, upwardly open, L-shaped slots 98 at its upper end (see FIGS. 3, 4, 5 and 7). The rim has inwardly projecting lugs 100 which are disposed in the lateral legs of the slots 98. A retaining clip 102 is secured in the vertical leg of at least one of the slots 98 to prevent rotation of the rim 22 relative to the bucket 80 and inadvertent separation of the rim from the bucket.

Each clip 102 comprises an upper U-section which is tensioned to grip the wall of the bucket. A tab 104 projects outwardly to positively prevent movement of the adjacent lug 100 into alignment with the vertical leg of the slot 94. Preferably the bucket 80 is formed of resinous "plastic" material and the clips 102 are formed of spring steel. The U-section of the clip 102 is provided with a tongue 106 which digs into the bucket so as to prevent inadvertent removal of the clip.

In addition to the mechanical connection between the rim 22 and bucket 80, thus provided, it is also preferred to provide a liquid seal therebetween. This end is attained by a sealing ring 108. The sealing ring 108 is compressed between an annular seat 110 formed on the undersurface of the rim 22 and a shoulder 112, which extends outwardly from the lower end of the upper cylindrical section 97 to an enlarged cylindrical section 114 of the bucket 80. The rim 22 has a depending annular flange 116 which is telescoped over the cylindrical section 114 to prevent tilting or the rim relative to the bucket 80. That is, it is desired to maintain the rim 22 and bucket 80 in coaxial relationship, with the annular portions of the ring at right angles to this common axis.

The upper portion of the rim 22 is defined by an outwardly projecting flange 118. The upper surface of which is angled downwardly away from the central opening defined by the rim. The lower surface of the flange 118 has downwardly projecting strengthening lugs 120 and bosses 122 which terminate in a common plane which defines the level to which the concrete apron A will be poured. A plurality of the lugs 120 are formed as anchor arms 124, disposed beneath notches 126, which facilitate casting of the rim.

An anchor 128 is mounted on each of the anchor arms 124 to be embedded in the concrete apron A and anchor the rim 22, and, thereby, the containment device 20, relative thereto. The anchors 128 are formed of spring steel, or like material, and comprise a central coil 130 with outwardly angled legs 132, which terminate in horizontal ends 134. The anchor arms 124 have enlarged outer ends 136 which maintain the anchors thereon during installation of the containment device. The anchor legs 132 are drawn toward each other to enlarge the diameter of the coil 130 so that it will pass over the enlarged end 136 to enable an anchor 128 to be mounted on an arm 124. Upon release of the legs 132, the coil 130 grips the arm 124.

After installation, the upper end of the containment device 20 is normally closed by a lid 138 which is supported by the rim 22. More specifically the lid 138 has a peripheral lip 140 which seats on the upper surface of the rim flange 118 and serves to prevent ground water from entering the bucket 80. Preferably, further dam means are provided to give greater assurance against ground water entering the bucket 80 and becoming a source of contamination of the fuel. These means comprise an annular rib 142 formed on the upper surface of the rim flange 118 and spaced inwardly of its central opening. Further dam means are provided by the upper portion of the upper shell portion 97 which projects above the flange 118. The undersurface of the lid 138 is relieved to clear the rib 142 and the upper end of the bucket 80 so that the lid lip 140 supports the lid and provides a sealing function.

Triangular, angularly spaced lugs 144 are provided on the rim flange 118, outwardly of the lid 138 and angled to the height of the upper, outer periphery of the lid. These lugs prevent inadvertent displacement of the lid, as by the blade of a snow plow, while permitting water to drain away from the opening to the containment device.

Figure 14:
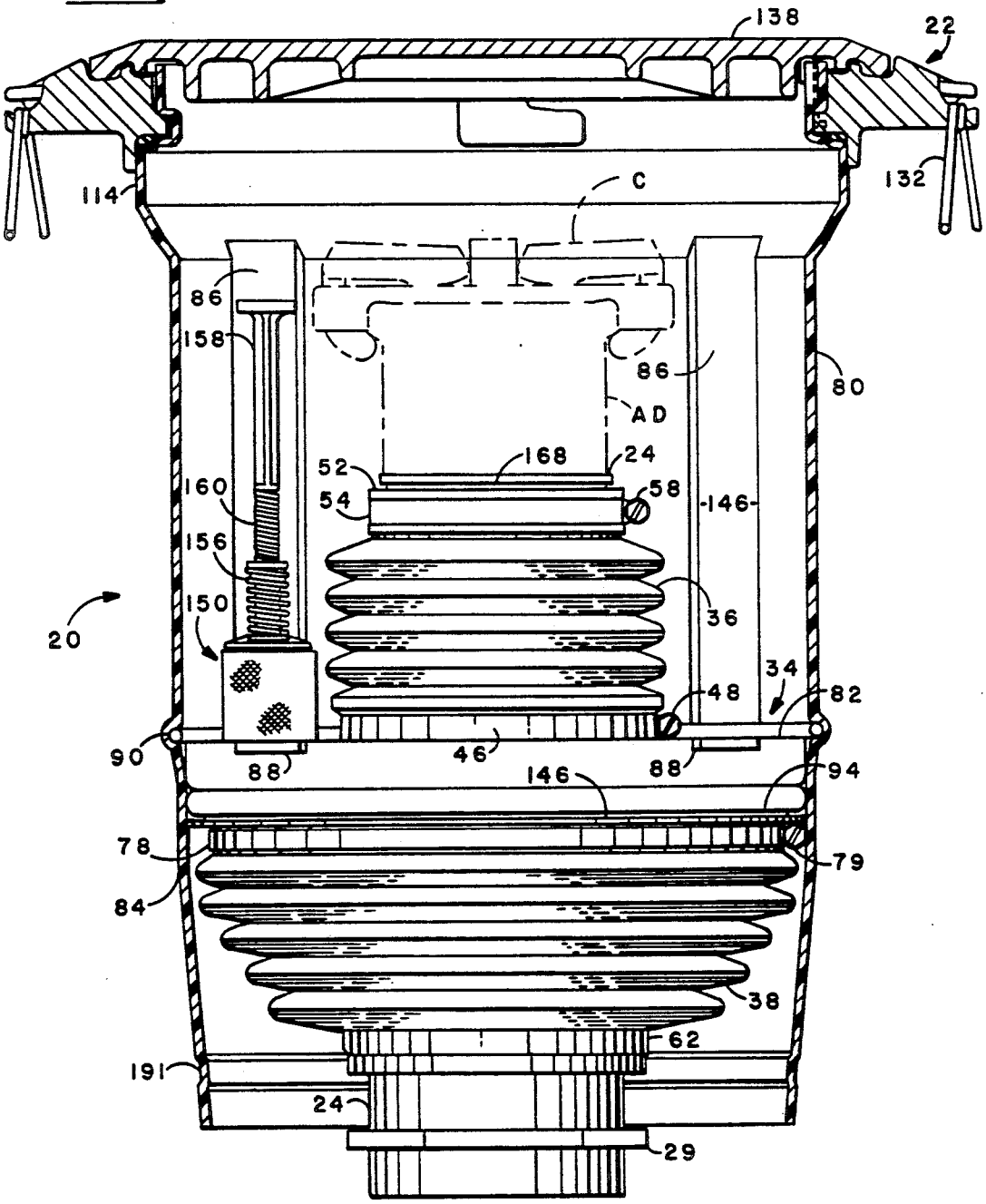
FIG. 14 is an elevation similar to FIG. 3, illustrating the exterior surfaces of certain components, and with adjusting components removed.

When installed in the fashion indicated in FIGS. 2 and 14, the containment device 20 is mounted on the fuel tank riser pipe P and a standard adapter AD has been attached to the upper end of the riser pipe extension 24. The lid 138 is removed and an appropriate connection is made between a fuel delivery hose and the adapter AD. After delivery is completed, the hose is detached from its connection with the riser pipe 24. Any fuel which spills from the delivery hose during this process is captured in the upper portion of the containment device which functions as a spillage container 146, defined by the bucket 80, the base member 34 and bellows 36.

Spilled fuel in the spillage container 146 is then inspected to make certain that it is not contaminated, water contamination being of particular concern, requiring the contaminated fuel to be removed from the spillage container for disposal at some remote location. If the spilled fuel is not contaminated, it is discharged into the fuel tank by way of a discharge chamber 148 defined by the base member 34 and the lower bellows 38.

A drain valve 150 provided at a low point in the base member 34. The drain valve controls drainage of fuel through a passage 151 through the bottom member 34 and is positioned in this passage by screws 153 and clamps 155 (FIG. 4).

The drain valve 150 is of conventional design and comprises a body member 152 and a poppet 154 (FIG. 3). The poppet 154 is at the lower end of a stem 155 and is maintained in sealing engagement with the body member 152 by a spring 156. The upper end of the poppet stem 154 is connected to an upper rod 158 by a flexible, spring connection 160. The upper rod 158 enables the poppet stem to be depressed and fuel thus drained into the discharge chamber 148. The flexible connection (spring 160) between rod 158 and valve stem 155 prevents damage to the poppet stem, or poppet, by accidental contact therewith as a hose connection is made with the riser pipe extension 24.

When the poppet stem is depressed to open the valve 150, fuel flows from the discharge chamber 148 through openings 162 in the riser pipe extension 24 and then drains through the riser pipe extension 24 into the riser pipe P and the tank T.

The described containment device provides significant benefits in facilitating its assembly and installation on the riser pipe of a storage tank, as well as its repair.

In the initial assembly of the containment device 20, the components including the riser pipe extension 24, base member 34 and the upper and lower bellows 36, 38 may be assembled as a sub-assembly. The lower bellows 38 may first be secured to the riser pipe extension 24 by ring nut 66 and sealed thereto by O-ring 70. The lower bellows 38 may then be secured to the base member 34 by the band clamp 78. The upper bellows 36 may then be secured to the base member flange 40 by the band clamp 46 and to the riser pipe extension 24 by the band clamp 54 and seal 60.

It will be noted that the upper sleeve portion 76 of the lower bellows 38 (FIG. 13) is provided with a radial flange 164 which positions the sealing ring 94 relative to its seat 96. The sealing ring 94 is, preferably, a component of the referenced, initial sub-assembly.

The major components of this sub-assembly, i.e., the riser pipe extension 24, the base member 34, the bellows 36, 38 and the principal components of valve 150 are, preferably, formed of "plastic" materials so that it is lightweight and readily manipulated during assembly. Nylon is an exemplary material suitable for these components. This is to say that the only metal components of this sub-assembly would be the band clamps 78, 46 and 54, the thread inserts 32 and, optionally, the ring nut 66, all of which have a relatively small mass.

The drain valve 150 (also a lightweight component) may also be installed as a part of this sub-assembly, or, optionally, a plug may be threaded into the opening for the drain valve. In either event, one end of the riser extension 24 may be plugged and pressurized air introduced through the opposite end to pressure the interior of the sub-assembly. This pressurization will reveal whether sealed connections have been properly obtained between the bellows 36, 38 and the riser pipe extension 24 and the base member 34. Leakage can be readily detected by immersing the pressurized sub-assembly in water.

The described sub-assembly is next assembled with the bucket member 80 simply by aligning the lugs 88 with the slots 86 and lowering the sub-assembly until the lugs 88 engage the bottoms of the slots 86, which serve as positioning shoulders or abutments. It is to be noted that the inner diameter of bucket permits the sealing ring 94 to freely pass thereover until the tapered section above the cylindrical portion 84 is reached. The decreasing diameter of this tapered section then compresses the sealing ring to provide an effective liquid seal between the bucket 80 and the base member 34.

After the sub-assembly is thus positioned, it is locked in place by the retaining ring 90, to provide an second sub-assembly, which is also relatively light, since the bucket is "plastic" and the retaining ring is of a low mass. This facilitates pressurized testing of the seal between the bucket 80 and the base member 34.

The rim 22 and lid 138 are the only metal components of the containment device which have significant mass. The rim 22, which may weigh in the order of 30 pounds, may be assembled on the second sub-assembly, which includes bucket 80, simply by aligning the lugs 100 with the vertical portions of the slots 94, lowering the rim and then rotating it to bring the lugs 100 into the horizontal portions of the slots 94. Assembly may then be completed by attaching the clips 102 in the slots 94. The lid 138 may also be set on the rim 22 and shipped as a component of the containment device.

The containment device 20 is installed on a riser pipe P, in the fashion above referenced by threading the riser pipe extension 24 onto the upper end of riser pipe P.

In laying out a storage tank installation, there will be a grade level, reference plane established for the upper surface of the apron A (FIG. 1). It is a common practice to install multiple tanks so that a plurality of containment devices which must be aligned (with respect to the lower surface of their rims 22) relative to the grade level. Installing tanks and riser pipes so that containment devices can be thus positioned relative to a reference plane with any degree of reliability, is a practical impossibility.

Figure 9:
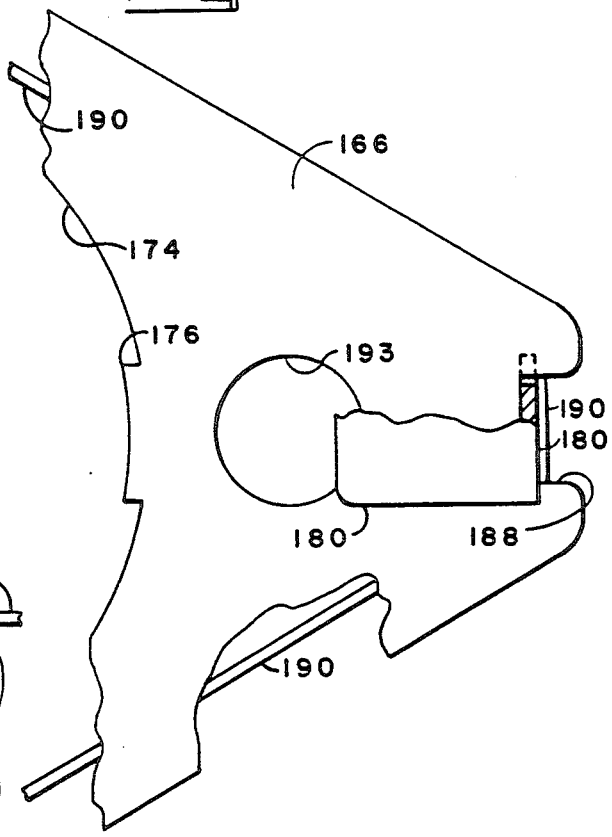
FIG. 9 is a view, on an enlarged scale, taken on line 9—9 in FIG. 3.
Figure 10:
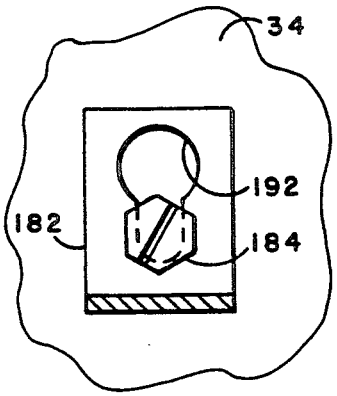
FIG. 10 is a view taken on line 10—10 in FIG. 9.

The present containment device overcomes this problem through the provision of means for adjusting the bucket 80 relative to the riser pipe extension 24. These means comprise a support plate 166 (FIGS. 3, 4, 8 and 9) which is mounted on the upper end of the riser pipe extension 24. To this end, a circumferential groove 168 is formed in the outer surface of the riser pipe extension 24, with vertical openings 170 therefor. The plate 166 has a central opening 174 with inwardly extending projections 176 (FIG. 9) which are alignable with the openings 170. The plate 166 is telescoped over the riser pipe extension 24 to bring the projections 176 into alignment with the groove 168 and then rotated to bring the projections into the groove 168. It is to be noted that the upper bellows flange 52 is provided with an inwardly extending sleeve extension 178 (FIG. 11). The bellows 36 being formed of a resilient material, the extension 178 provides a restraining force which prevents rotation of the plate 166 and its inadvertent separation from the riser pipe extension 24.

The adjustment means further comprise three vertical, support arms 180. The support arms have horizontal tabs 182 which are clamped to the base member 34 by screws 184. Each support arm 180 has a series of notches 186 along its opposite side edges. The notches 186 are disposed in a series of sets of notches with each set of notches lying generally in a plane normal to the axis of the bucket member 80. The plate 166 has notches 188 which respectively receive the support arms 180 with the marginal portions thereof engaging the arm notches 186. Rubber bands 190 embrace the support arms 180 to yieldingly maintain the arms in engagement with the plate notches 188.

When the containment device is initially assembled, the support arms 180 maintain the bucket 80 (and rim 22) in a nominal vertical relationship with respect to the riser pipe extension 24 and also maintain the plane of the rim 22 at right angles to the vertical axis of the riser pipe extension.

After the containment device 20 has been mounted on a riser pipe P, the orientation of the rim 22 relative to the desired grade level, reference plane is checked. If the rim is too high or too low, the support arms 180 are released from the plate notches 188 and then reengaged therewith after the rim has been positioned at the desired height. If the riser pipe P has angled from a vertical position, the rim 22 will be correspondingly angled from a horizontal plane, which is its usual, desired orientation. In such a situation, one or more of the plate notches 188 can be shifted for engagement with a different set of arm notches 186 to thereby tilt the bucket 80 relative to the riser pipe extension 24 and thereby bring the rim 22 to the desired angular relation relative to the grade level, reference plane.

After the desired relationship of the rim 22 has been established, as just described, the excavation is backfilled and the apron A poured and to complete the installation of the containment device. The rim 22 is anchored in the concrete apron and the relationship of the device with the riser pipe P and the tank T is thus established.

In backfilling the excavation there is the possibility that gravel, or the like, might be introduced into the lower end of the bucket 80 and damage the lower bellows 38 or the seal between the sealing ring 94 and the bucket. This is particularly so where the back fill is introduced in the form of a water slurry.

To eliminate this potential problem, after the containment device 20 is mounted on the riser pipe P, an open ended bag, or sleeve, B is connected between the lower end of the bucket 80 and the adjacent portion of the pipe P, as indicated in FIG. 1 and 3. The bag B provides a protective barrier when the excavation is backfilled and remains in place after installation to provide protection against shifting of backfill material to a position which could damage the lower bellows 38.

The bag B may be of polyethylene film which is readily conformed to the diameters of the bucket 80 and pipe P. The bag B may be secured in place twisted wires W. This protective procedure may be readily employed in the field and, while not sophisticated, has been found highly effective.

The containment device 20 is adapted to facilitate this protective function through the provision of a circumferential groove 191 formed in the outer surface of the bucket 80, adjacent its lower end. The groove 191 facilitates the attachment of a clamp means for securing the bag B to the bucket 80, as well as giving greater assurance that the bag B will not be pulled free therefrom. The provision of the groove 191 further facilitates the use of this type of protection where the lower end portion of the bucket is tapered inwardly to enable the application of a hoop clamp, as above described.

At this point the supporting arms 180, having served their purpose, are removed and may be discarded. Keyhole slots 192 in the support arm tabs 182 facilitate this removal, as well as initial mounting of the support arms 180. It will also be seen that the openings 193 are generally registered with the screws 184 to permit access thereto by a socket wrench mounted on an extension. The support plate 166 may also be removed, or may be left in place and serve as a means for mounting notices or instructions for use of the containment device.

FIG. 14 illustrates the containment device with the adjusting means removed. Also illustrated, in phantom, in this figure is an adapter AD, which has been mounted on the upper end of the riser pipe extension 24 by being threaded into the female threaded portion 30 (FIGS. 3 and 11). The adapter AD has an industry standard configuration which enables a fuel delivery hose to be connected thereto. In FIG. 14, a cap C, also illustrated in phantom, seals the upper end of the adapter AD. When fuel is to be delivered into the storage tank, the cap C is removed and a delivery hose is connected to the adapter AD in a conventional fashion.

It is also to be appreciated that the described positioning arms 180 and plate 166 provide protection for the containment device during shipping and as it is otherwise handled prior to being installed. This is to say that by maintaining a fixed relation between the riser pipe extension 24 and the bucket member 80, there is little or no stress on the bellows 36, 38, nor movement which could damage the components of the containment device.

The spill containment device, as installed, serves the basic function maintaining its integrity during periods of climatic change. This is to say that the apron A will shift relative to the tank T, as may be caused by frost heaves, causing movement of the rim 22 and bucket 80 relative to the riser pipe extension 24 which is secured to the riser pipe P.

When this occurs, the flexible bellows 36, 38 will expand or contract, dependent on the direction of relative movement. Likewise, it there is a lateral shift, the flexibility of these bellows will permit the same while maintaining the spill containment features which prevent fuel from polluting the subsoil where the tank is installed. Lateral movement is permitted within the clearance between the riser pipe extension 24 and the central opening 42 of the base flange 40. The bellows 36 and 38 are preferably molded from an elastomeric material which provides the desired characteristics of flexibility and resiliency. Suitable elastomeric materials, which additionally resist deterioration when exposed to fuels, are well known.

The containment device 20 also facilitates repair and maintenance. To this end, the base member 34 is readily removable from the bucket 80, after installation. The band clamps 54 and 46 are removed, or loosened so that upper bellows 36 can be removed. This accessibility to the band clamps 54 and 46 also permits replacement of the upper bellows 36 if that is the only maintenance action required.

After removal of the upper bellows 36, a tubular wrench can be telescoped over the riser pipe extension 24 and pass through the opening 42 to engage the ring nut 66. The ring nut has lugs 194 which would be engaged by slots in the end of the tube wrench to unthread the ring nut. The retainer ring 90 is then removed from the slot 92. Hooks 91 (FIG. 4) are provide on the ends of the retaining ring (snap ring) 90 to facilitate its removal. The base member 34 may then be raised vertically from the bucket 80 for inspection and replacement, as necessary, of the lower bellows 38, the O-ring 70 and the sealing ring 94.

After inspection and/or replacement of components, the base member 34 is remounted in the bucket 80 and the upper bellows 36 secured in place in reverse fashion to their removal.

The described containment device 20 comprises a spillage container (generally defined by the bucket 80, bottom member 34 and upper bellows 36) which is sized to hold approximately five gallons of spilled fuel. This volume is sufficient to contain "normal" spillage of fuel in making and breaking a hose connection when the storage tank is to be filled.

Figure 15:
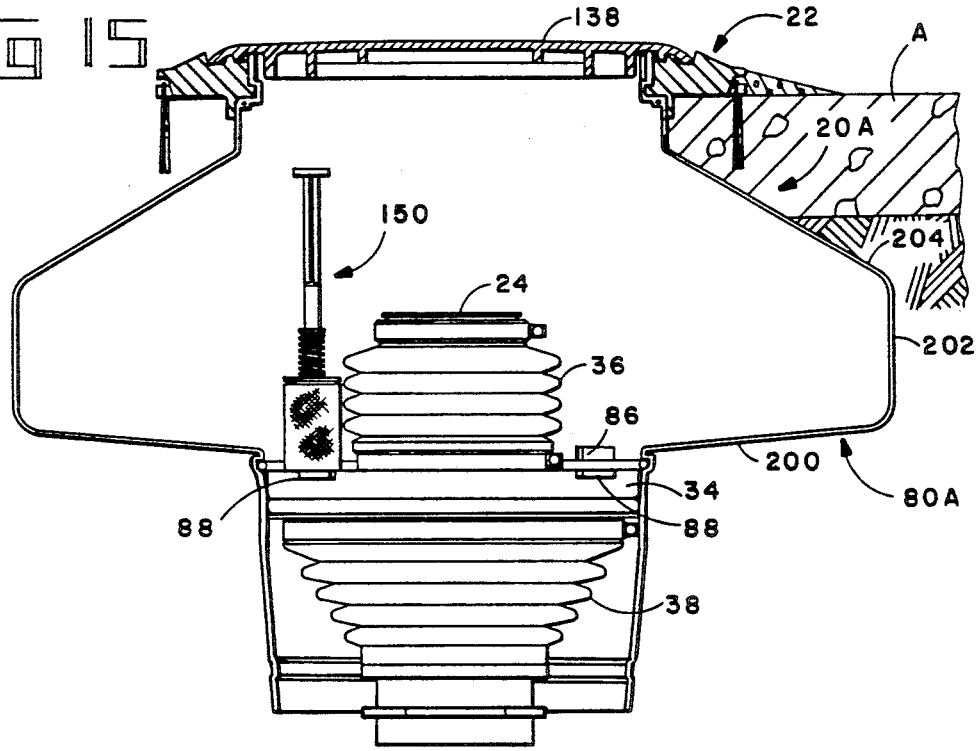
FIG. 15 is an elevation, in section, of an alternate embodiment of the invention, which has an increased capacity.

This volume is not, however, sufficient to contain abnormal spillages which can occur. One measure of an abnormal spillage is the volume of fuel in the hose connecting the delivery tank truck to the riser pipe. This volume, generally, approximates twenty-five gallons. FIG. 15 illustrates a containment device 20A providing this increased containment capacity capability.

The device 20A comprises a modified bucket 80A which has an annular bottom portion 200, an enlarged cylindrical portion 202 and an inwardly tapered portion 204 which extends to a cylindrical portion which has been identified by reference character 114 to indicate that it corresponds to the correspondingly identified cylindrical section of bucket 80 of the first described embodiment.

The bucket 80A from the cylindrical section 114 is identical with the bucket 80. A rim 22 and lid 138 are thus mounted on the bucket 80A in a fashion identical with that previously described.

Similarly, portion of the bucket 80A, below the bottom section 200 may be identical with the corresponding portion of the previously described bucket 80. Such portions are identified by like reference characters.

The containment device 20A may, therefore, comprise the same sub-assembly of a riser pipe extension 24, bottom member 34 upper bellows 36 and lower bellows 38. Vertical slots 86 are formed in this lower portion of the bucket 80A and receive the lugs 88 projecting outwardly from the bottom member 34 so that the bottom member is positioned relative to the bucket 80A. A snap ring 90 then releasably holds the bottom member (and the remainder of the sub-assembly, in this assembled relation.

Although not shown, the adjustable positioning means comprising arms 180 and plate 166 may also be employed in this embodiment.

Installation of the containment device 20A would be the same as previously described. One point to be noted is the tapered upper wall 204 of the bucket 80A serves the function of enabling the concrete apron, adjacent the upper end of the bucket, to have a thickness, and strength, sufficient to bear the weight of heavy vehicles that might be driven thereover. The angled section of concrete provides the necessary strength, which at the same time, the diameter of the cylindrical section 202 is minimized.

In a similar vein, repair and/or replacement of the bellows 36 and 38 and other sealing means associated with the sub-assembly, would be as previously described.

Figure 16:
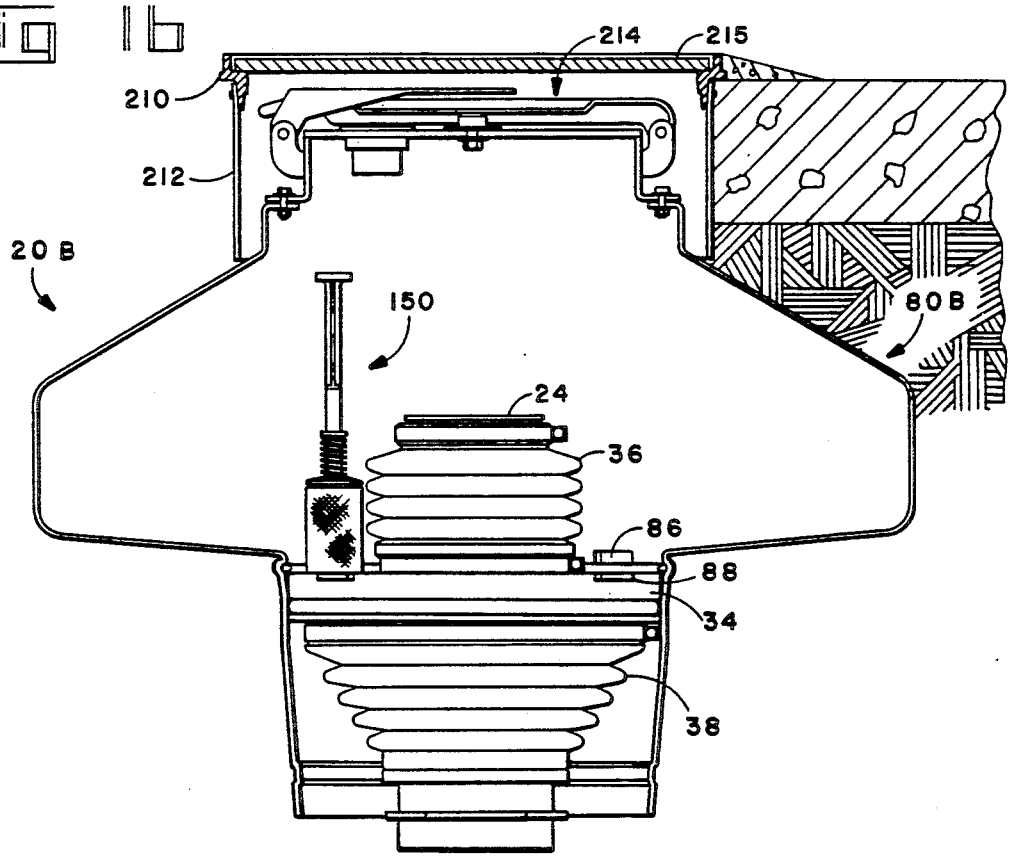
FIG. 16 is an elevation, in section, of an alternate, "below grade" embodiment of the invention.

Next, FIG. 16 illustrates a containment device 20B for what is as known as a below grade installation.

In this type of installation a man hole 210 is provided separately from the containment device. The man hole comprises a shell 212 into which the upper end of the containment device 20B extends, with a lid 215 normally closing the upper end of the man hole.

The containment device is also of the large capacity type, comprising a bucket 80B having walls 200, 202, 204 and 114 as previously described. Likewise, the same subassembly comprising riser pipe extension 24, bottom member 34 and bellows 36, 38 may be mounted as described in connection with the previous embodiment.

The device 20B differs from the previous embodiments in that it is not proved with a rim member and lid. Instead, its upper end being below grade level, i.e., the upper surface of apron A, a non-load bearing, removable closure 214 is provided. The upper end portion of the bucket 80B, above the cylindrical section 114 is modified, as shown, for mounting of the closure 214 thereon.

The device 20B is installed in a fashion similar to that previously described. The riser pipe extension 24 is mounted on a storage tank riser pipe (again arms 180 and a plate 166 could be provided for height and angular adjustment). After backfilling, the manhole 210 is positioned and the apron A poured.

In use, the lid 215 is removed and then the closure 214 (which is of known design) is opened. The delivery hose is then inserted into the bucket 80B for connection with the riser pipe extension 24.

Figure 17:
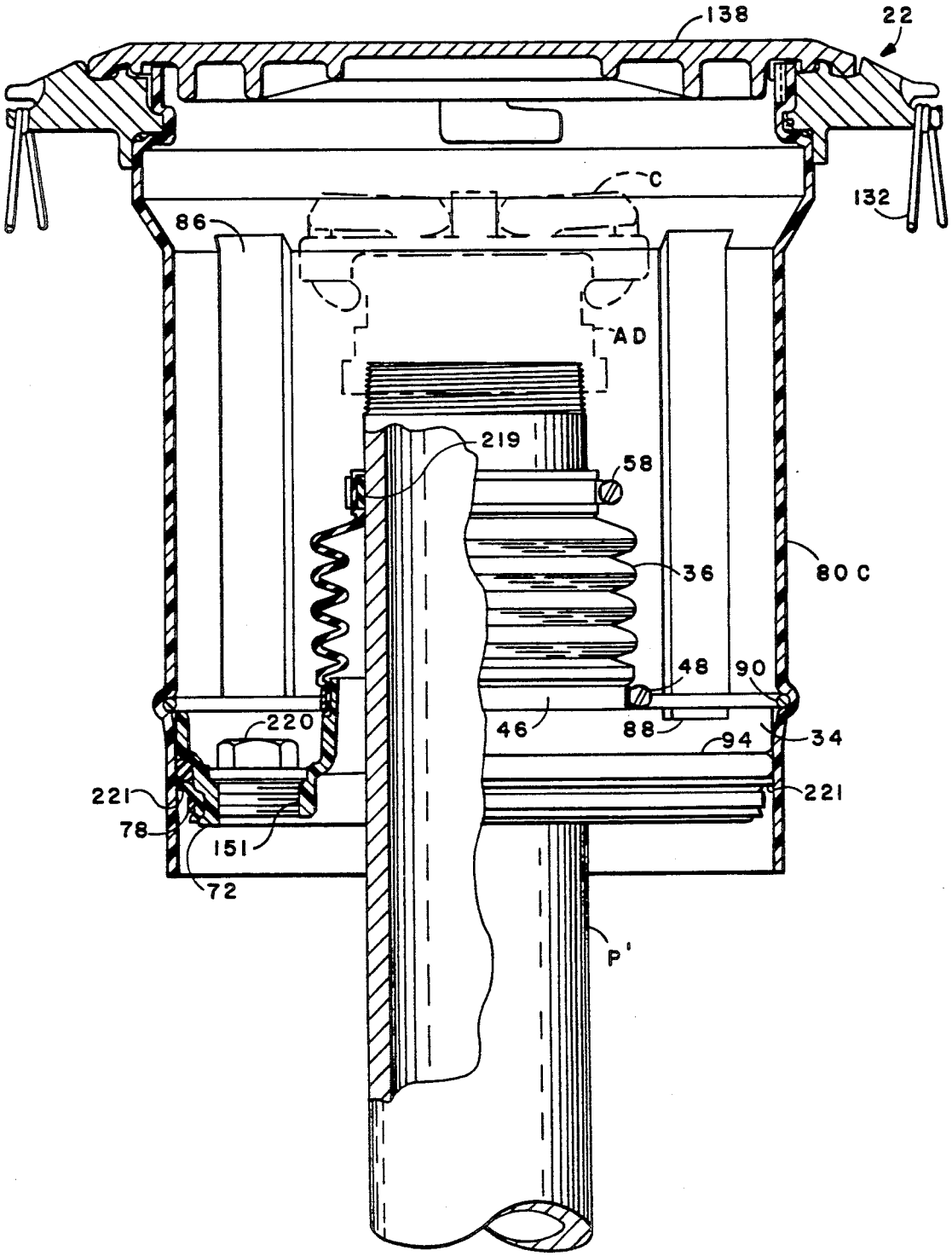
FIG. 17 is an elevation, in section, of an alternate embodiment of the invention employed in retrofitting existing fuel tanks with a spill containment device.
Figure 11:
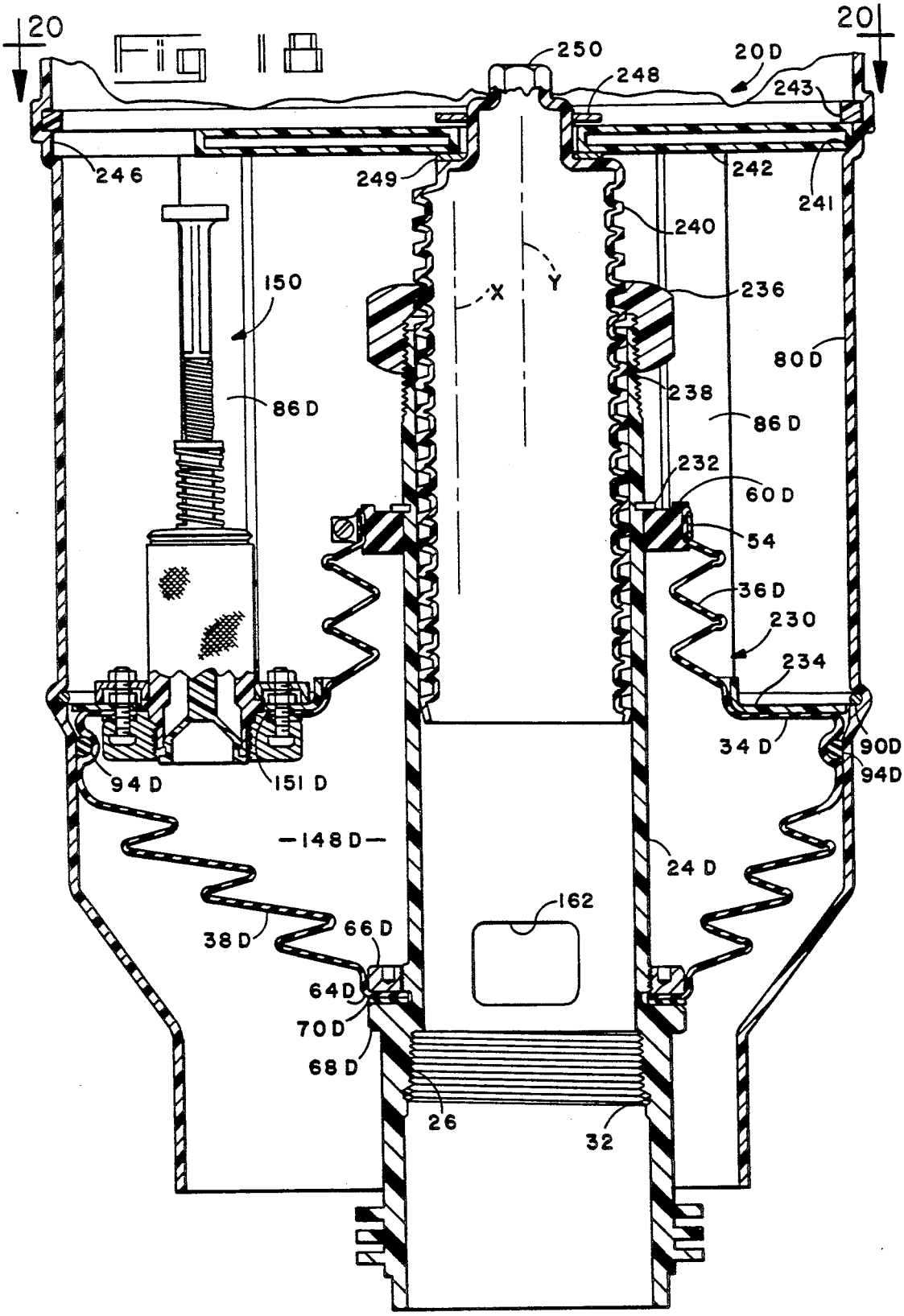

FIG. 17 illustrates a containment device 20C which is particularly adapted for retrofitting existing storage installations in an econmical fashion. This containment device differs from the first described device 20 in that it does not provide the capability of draining fuel from a spillage container into the storage tank. Accordingly, the components which provide this function are not used in the device 20C.

The device 20C thus comprises a bucket 80C which differs from the bucket 80 only in that its lower end has been shortened. A bottom member 34 is positioned by lugs 88 and bucket grooves 86 and removably held in assembled relation by a snap ring 90.

The bucket 80C, bottom member 34 and a bellows 36 provide a spillage container in the same fashion as previously described. The lower end of the bellows 36 is clamped to a bottom member flange 40 which defines an opening through which the storage tank riser pipe P' extends. The upper end of the bellows 36C is clamped directly against an existing riser pipe P', through a sealing ring, or gasket, 219.

Consistent with elimination of the drainage feature, the valve 150 is not provided for the containment device 20C. Economies are attained by using the same bottom member 34. To enable this to be done, the drain passage 151 is threaded and a plug 220 inserted therein.

Without further description, it will be apparent that the rim 22 and lid 138 are mounted on the bucket in the same fashion as in containment device 20.

In installing the containment device 20C on an existing storage tank, a minimum of excavation is required. The existing concrete apron would be removed, along with whatever manhole had previously been in use. The underlying soil would be excavated to a depth sufficient to accommodate the containment device 20C. The device 20C would then be positioned on the riser pipe P' in the fashion illustrated. The band clamp 54 would then be tightened to sealingly connect the upper end of the bellows 36C to the riser pipe P'. Soil or gravel would be appropriately backfilled around ant lower portion of the bucket 80C and concrete poured to patch the portion of the apron which had been removed.

Although not shown, it will be appreciating that adjusting means could also be provided to obtain a desired relation between the upper end of the bucket and the riser pipe P'. Similar vertical support arms 180 would be mounted on the base member 34. A corresponding support plate 166 could then be mounted on the riser pipe P', as by temporarily providing a support therefor on the riser pipe P'.

This embodiment also facilitates maintenance in that the bellows 36 and base member 34 are removable for such purpose. It will be seen that a flange ring 221 is mounted on the base member flange 72, by clamp 78 to position the sealing ring 94 thereon, since the lower bellows, which previously provided this function, has been omitted.

Figure 19:
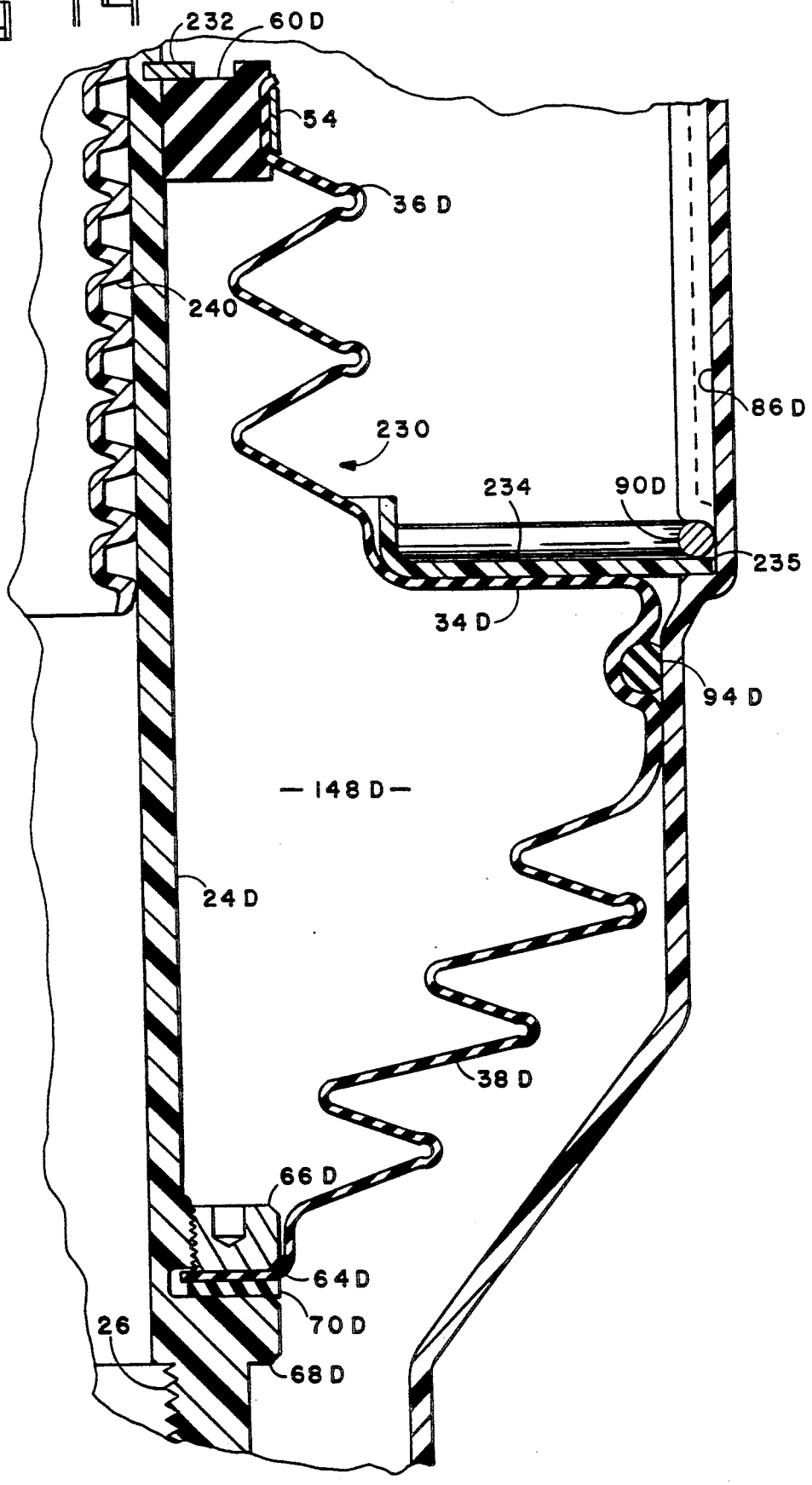
FIG. 19 is a view of a portion of FIG. 18, on an enlarged scale.
Figure 20:
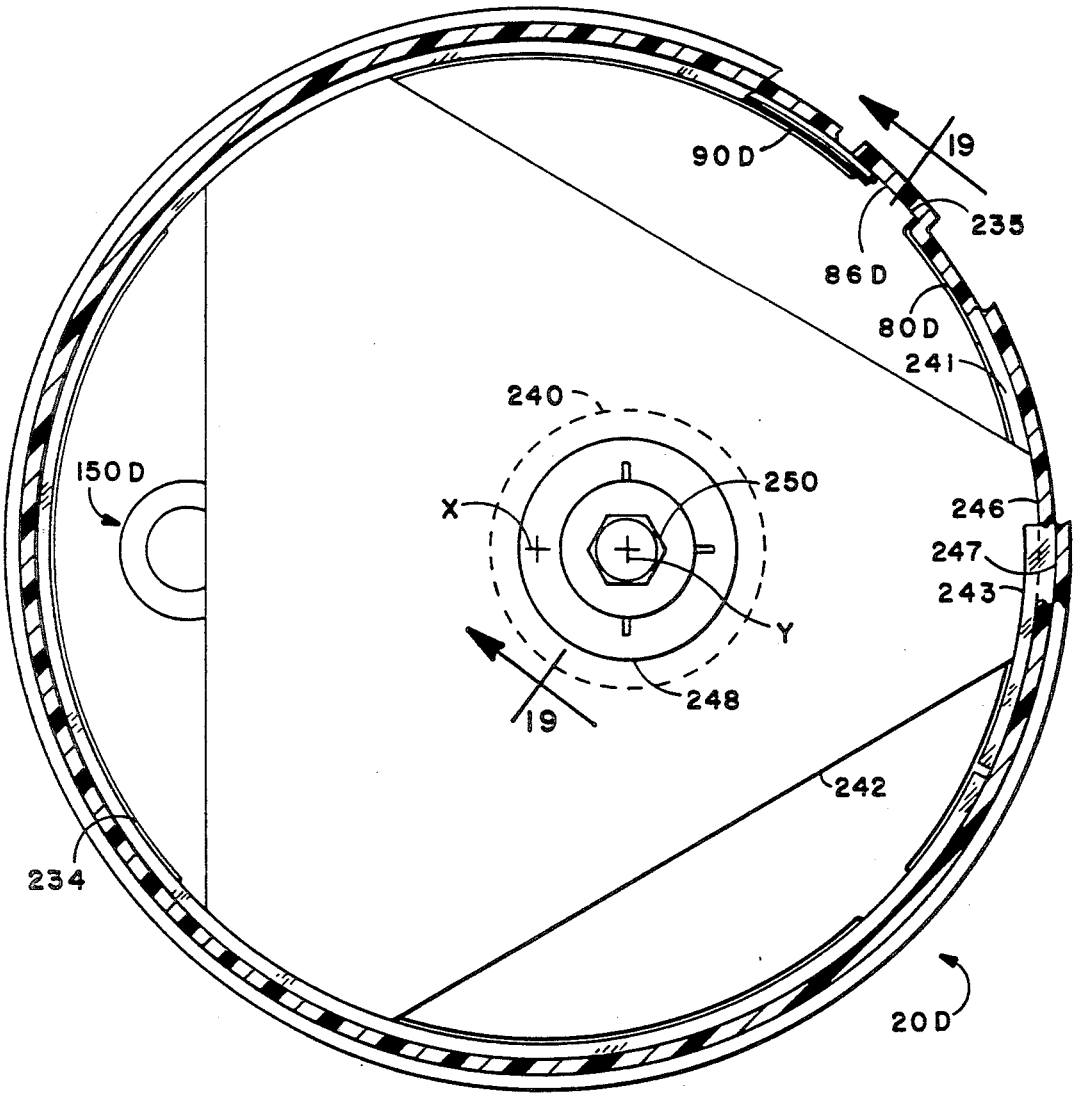
FIG. 20 is a section taken on line 20—20 in FIG. 18.

Reference is next made to FIGS. 18–20 for a description of a further containment device 20D.

The device 20D comprises components which are functionally equivalent to those found in the previously described, containment device 20. Thus, there is a subassembly comprising a riser pipe extension 24D and a separating member 230. The separating member 230 is formed of an elastomeric material, preferably molded as a unitary structure, and comprises an upper bellows section 36D, a bottom forming portion 34D and a lower bellows section 38D.

The upper end of the bellows section 36D is releasably clamped to the riser pipe extension 24D by a band clamp 54, acting through a sealing ring 60D. The sealing ring 60D is axially positioned on the riser pipe extension 24D by a snap ring 232.

The lower end of the lower bellows section 38D has an inwardly projecting flange 64D which is clamped by a ring nut 66D against a flange 68D, on riser pipe extension, through a gasket type sealing ring 70D.

The bottom forming section 34D may be bonded by an appropriate adhesive to a bottom plate 234 and is removably secured in a bucket 80D in essentially the same fashion as the base member 34 is mounted on the bucket 80. Thus the plate 234 has lugs 235 which are seated in the bottoms of grooves 86D and releasibly maintained in assembled relation by a snap ring 90D.

A large O-ring 94D is disposed in a groove formed in the separating member 230, adjacent the bottom forming section 34D, and sealingly engages the bucket 80D.

The bucket 80D, bottom forming section 34D and upper bellows section combine to form an upwardly open, spillage container. The bottom forming section 34D and lower bellows section 38D combine to form a lower drainage chamber 148D.

As in the containment device 20, a passage 151D is provided through the bottom forming section 34D (and plate 234) to enable spilled fuel to be drained from the spillage container into the lower, drainage chamber 148D. A valve 150D is appropriately mounted on the bottom forming section 34D (and plate 234) to selectively control drainage of fuel into the lower drainage chamber 148D.

The upper end of the bucket 80D (not shown) may be provided with a rim and lid in the same fashion as described in connection with the containment device 20.

The containment device 20D is, likewise, mounted on a storage tank riser pipe by a threaded section 26 formed at the lower end of the riser pipe extension 24D.

Alternate means are provided for establishing a desired relation between the upper end of the containment device 20D (as represented by the upper end of the bucket 80D, or a rim mounted thereon) and the riser pipe on which it is mounted.

These means comprises a ring nut 236 which is mounted on the upper end of the riser pipe extension 24D by a threaded connection 238. A vertical adjusting screw 240 is threaded into the ring nut 236 and has a outer diameter approximating the inner diameter of the riser pipe extension 24D. A Triangular plate 242 is mounted on the upper end of the adjusting screw 240 and has its corners received in a groove 246 formed in the bucket 80D. The plate 242 is captured on the upper end of the adjusting screw 240 a "push nut" 248 and a wear washer 249. The outer ends of the plate 242 are captured between the bottom surface 241 of the groove 246 and a split retaining ring 243. The retaining ring 243 is thus releasably mounted in a groove 247 to permit assembly and disassembly of the plate 242.

In order to obtain a vertical adjustment of the upper end of the bucket member 80D, the adjusting screw 240 is rotated to raise or lower the bucket 80D relative to the riser pipe extension 24D. To this end a torquing nut 250 is provided at the upper end of the adjusting screw 240.

The described means also provide for angular adjustment of the bucket 80D relative to the riser pipe extension 24D to compensate for deviations of the storage tank riser pipe from a vertical position. Thus it is to be noted that the axis Y of the riser pipe extension 24D is laterally spaced from the axis X of the bucket 80D, and, in the nominal, central position illustrated in the drawings, is parallel thereto. Angular adjustment is obtained by rotating the plate 242 relative to the bucket 80D and screw 240. When this is done, an angular relation is created between the two axes, to bring the axis of the riser pipe extension to a vertical position, where the riser pipe extension 24D is mounted on a storage tank riser pipe which is angled from a vertical position.

The described adjusting mechanism permits the upper end of the bucket to be brought to a predetermined height and angular relationship (usually bringing a rim member to a horizontal orientation) for the pouring of a concrete apron, as previously described.

After the apron has been poured, anchoring the bucket 80D in a fixed position, the plate 242 is removed by disengagement of the retaining ring 243 and removal of the "push nut" 248. The nut 236 is unthreaded from the threads 238 and screw 240 is removed so that the containment device is then ready for its intended function of capturing fuel in the spillage container. The threaded portion 238 may then be used to mount an adapter on the upper end of the riser pipe extension 24D.

Spilled fuel may then be drained, as before, by opening the valve 150D to drain it into the chamber 148D. Openings 162 in the riser pipe extension 24D then permit the spilled fuel to be drained into the storage tank.

The integral separating member 230 minimizes the number of connections where leakage could occur. Still, there is a possibility of leakage at the sealed connections between the riser pipe extension 24D and the bellows sections 36D and 38D, or between the separating member 230 and the bucket 80D.

Maintenance of the unit, in the event, of such leakage is facilitated by the removable mounting of the separating member 230. This is accomplished by removing the band clamp 54 to free the upper end of the bellows section 36D from the sealing ring 60D. (The adjusting means including nut 236 have been removed, when such maintenance action is undertaken.) The snap ring 232 is then removed to permit removal of the sealing ring 60D. The upper end of the bellows section 36D is thus spaced from the riser pipe extension 24D sufficiently for a tubular wrench to be telescoped over the riser pipe extension 24D. The wrench would have pins, which are engaged with openings in the ring nut 66D. The ring nut 66D may thus be unthreaded to disengage the lower end of the lower bellows section 38D from the riser pipe extension 24D.

Additionally, the bottom forming portion 34D is released from the bucket 80D, by removing snap ring 90D from its retaining groove.

The separating member 230 is then removed from the bucket 80 and appropriate maintenance performed. The separating member, or a replacement separating member, may then be installed by clamping the lower end of the lower bellows section 38D to the riser pipe extension 24D and mounting the bottom forming section 34D in assembled relation with the bucket 80D. The sealing ring 60D would then be reinstalled and the upper end of the bellows section 36D clamped thereto.

Reference is made herein to the storage and spillage of fuels, which would, in most cases, would be petroleum based fuels. However, the advantages of the present invention would be equally effective in the storage of and prevention of contamination by other hazardous liquids.

Further variations in the structural features of the described embodiments will occur to those skilled in the art, within the spirit and scope of the present inventive concepts, as set forth in the following claims.

Having thus described the invention, what is claimed as novel and desired to be secured by Letters Patent of the United States is:

1. A containment device for preventing soil contamination in filling underground storage tanks of the type having riser pipe means, terminating below ground level, through which fuel, or other potentially hazardous liquid, flows into a storage tank, said device comprising a bucket member in the form of a vertically disposed shell, a riser pipe extension adapted to be mounted on a storage tank riser pipe and comprises the riser pipe means, a bottom member secured in fixed, assembled relation to said bucket and having an opening through which the riser pipe extension projects in spaced relation thereto, said riser pipe extension having an upper end portion above the bottom member and a lower end portion disposed beneath the bottom member, an upper flexible member extending between the bottom member and the upper portion of riser pipe extension to provide for relative movement between the bucket member and the riser pipe means, said bucket member, bottom member and upper flexible member defining an upwardly open, spillage container, a lower, flexible member extending between said bottom member and the lower portion of said riser pipe extension and defining, at least in part, a lower chamber beneath said spillage container.

2. A containment device as set forth in claim 1 further comprising means for draining fuel from the spillage container to said lower chamber and then into the lower portion of said riser pipe extension.

3. A containment device as set forth in claim 2 wherein the means for draining include a passageway extending through said bottom member, a selectively actuable valve for controlling fuel flow through said passageway, and openings in the riser pipe extension.

4. A containment device as set forth in claim 3 wherein the bottom member is a generally planar annulus, the opening through the bottom member is defined by an upstanding annular flange, the upper flexible member is an elastomeric, tubular bellows having a lower end sealingly connected to said upstanding flange and an upper end sealingly connected to the upper portion of the riser pipe extension.

5. A containment device as set forth in claim 4 wherein the bottom member has a depending annular flange, and the lower flexible member is an elastomeric, tubular bellows having an upper end sealingly connected to said depending flange and a lower end sealingly connected to the lower portion of the riser pipe extension.

6. A containment device as set forth in claim 5 wherein the diameter of the depending, bottom member flange is substantially greater than opening defining flange, and the drain passageway is disposed between said flanges.

7. A containment device as set forth in claim 6 wherein the upper and lower ends of the upper bellows are connected by removable band clamps, permitting removal of the upper bellows for repair or replacement.

8. A containment device as set forth in claim 7 the bottom member is releasably secured relative to said bucket member and is capable, when released, of being withdrawn from the bucket, the lower end of the lower bellows is releasably clamped to the riser pipe extension by means accessible through the opening in the bottom member, when the upper bellows is removed.

9. A containment device as set forth in claim 8 further comprising a sealing ring disposed between an annular groove in said bottom member and a cylindrical surface on said bucket member to provide a fluid seal therebetween, and wherein the upper end of the lower bellows comprises an outwardly extending flange which, in part defines the groove for said sealing ring and maintains the sealing ring on the bottom member when it is removed from the bucket.

10. A containment device as set forth in claim 8 wherein the portion of the bucket member, above the bottom member, is generally cylindrical and has vertical grooves opening onto the interior thereof, said grooves being upwardly open and terminating in supporting abutments at their lower ends, adjacent the bottom member, and the bottom member has an outer periphery which is telescopable into and out of the upper end portion of said shell and has lugs projecting from said periphery into said vertical grooves, said lugs engaging the bottoms of said grooves in the assembled position of said bottom member.

11. A containment device as set forth in claim 10 wherein a circumferential groove is formed on the inner surface of said bucket, above the bottoms of said vertical grooves, and a snap ring is engaged in said circumferential groove and overlies said bottom member lugs to maintain said bottom member in assembled relation, said snap ring being manually releasable from said circumferential groove to permit removal of the bottom member.

12. A containment device as set forth in claim 11 further comprising a sealing ring disposed between an annular groove in said bottom member, below said lugs and further wherein the bucket, beneath the bottoms of said vertical slots, is tapered inwardly to a reduced diameter which is engaged by the sealing ring in the assembled relation of the bottom member, whereby, the sealing ring will be compressed into sealing engagement with the bottom member and bucket.

13. A containment device as set forth in claim 10 wherein the bucket member and bottom member are formed of light weight, resinous material, and further comprising a metal rim, in the form of an annulus, having inner and outer cylindrical surfaces, mounted on the upper end of said bucket member, said rim being disposed, generally at right angles to said bucket member, and a removable lid, supported by said rim and closing the upper end of said spillage container.

14. A containment device as set forth in claim 13 wherein the upper end of the bucket member has L-shaped grooves which are open at the upper end of the thereof, the rim has inwardly projecting lugs which are receivable in said L-shaped slots, permitting the rim to be telescoped over and then rotated with respect to said shell to bring said lugs into the horizontal portions of said L-shaped slots, thereby locking the rim thereon.

15. A containment device as set forth in claim 14 wherein the upper surface of the rim angles downwardly from the its inner diameter, the bucket has shoulder means projecting outwardly therefrom, spaced beneath the upper end thereof, and providing support for said rim, means providing a liquid seal between the rim and the bucket, and further wherein the upper end of the bucket member projects above the upper surface of said rim to provide dam means for limiting the flow of water into the spillage container.

16. A containment device as set forth in claim 15 wherein an annular rib projects upwardly from the upper surface of the rim, and the lid has a peripheral lip which engages the upper surface of the rim outwardly of said rib and supports the lid thereon.

17. A containment device as set forth in claim 13 further comprising a plurality of anchors, mounted on said rim, for insuring a firm attachment between the containment device and a concrete apron, each anchor being formed of metal wire and comprising a pair of downwardly angled legs connected by a central coil.

18. A containment device as set forth in claim 17 wherein the rim has lugs disposed beneath its upper surface and the anchors are, respectively, mounted on said lugs, the coil of each lug being expanded to yielding grip the lug on which it is mounted.

19. A containment device as set forth in claim 1 further comprising means for adjusting the relative relationship between the upper end of said bucket and said riser pipe extension, said adjusting means being disengageable, whereby, when the containment device is mounted on a riser pipe; the top of the bucket member brought to a desired position; the top of the bucket secured in place in the installation process, and then the adjusting means disengaged to permit said relative movement to occur as may be occasioned by natural forces.

20. A containment device as set forth in claim 19 wherein the adjusting means has the capability of adjusting the height of the upper end of the bucket, relative to the riser pipe extension, and also the angular relationship therebetween, and said adjusting means are effective between said bottom member and said riser pipe extension.

21. A containment device as set forth in claim 5 further comprising means for adjusting the relative relationship between the upper end of said bucket and said riser pipe extension, said adjusting means comprising a plurality of vertical arms mounted on the bottom member and means providing an adjustable connection between said arms and the upper end of said riser pipe extension.

22. A containment device as set forth in claim 21 wherein there are three vertical arms, and the means comprising an adjustable connection comprise a plate mounted on the riser pipe extension at right angles thereto, and notch means providing engagment between said plate and said vertical arms, said notch means being selectively engageable to provide for establishment of a desired heightwise and angular relation between the bottom member and bucket member, relative to said riser pipe extension.

23. A containment device as set forth in claim 22 wherein the three arms are equiangularly spaced and removably mounted on said bottom member, the notch means comprise a series of notches formed along the height of said arms and notches on said plate, respectively engageable therewith, the vertical arms may be flexed outwardly from said plate to permit heightwise adjustment of the plate with respect to each of the vertical arms, and further comprising elastomeric band means encircling said arms and yieldably maintaining said notch means in engagement.

24. A containment device as set forth in claim 23 wherein the riser pipe extension has a circumferential groove at its upper end, with vertical slots opening from groove onto the end face of the riser pipe extension, said plate has a central opening telescoped over the upper end of the riser pipe extension and inwardly projecting lugs, which pass through said vertical slots and then are engaged with said circumferential groove by rotation of the plate, and further wherein the upper end of the upper bellows resiliently engages the undersurface of said plate to prevent its rotation to a position in which it could be inadvertently disengaged from the riser pipe extension.

25. A containment device as set forth in claim 13 wherein the riser pipe extension has a female pipe thread in its lower end for connection with a male threaded storage tank riser, the initial portion of said female pipe thread is formed by a metal insert, a tapered guide bore extends from the initial portion of said female pipe thread toward the lower end face of the riser pipe extension, whereby mounting of the containment device on a storage tank riser is facilitated.

26. A containment device for preventing soil contamination in filling underground storage tanks of the type having riser pipe means, terminating below ground level, through which fuel flows into the storage tank, said device comprising a bucket member in the form of a vertically disposed shell, a bottom member having an assembled relation in which it defines an upwardly open, spillage container in combination with the bucket member, said bottom member having an opening through which the riser pipe means projects, and a flexible member secured to the bottom member and having opening defining means adapted to be sealingly secured to the riser pipe means to define a spillage container and to provide for relative movement between the bucket member and the riser pipe means, characterized in that the bottom member is capable of being telescoped through the upper end of said bucket member to and from said assembled relation, releasable means lock said bottom member in said assembled relation, and releasable means are provided for clamping the opening defining means of said flexible member to said riser pipe means, whereby the bottom member and flexible member may be separately removed from the bottom member for repair or replacement.

27. A containment device as set forth in claim 26
the bottom member is a generally planar annulus,
the opening through the bottom member is defined by an upstanding annular flange,
the flexible member is an elastomeric, tubular bellows having a lower end sealingly clamped to said upstanding flange and an upper end providing the means defining the opening adapted to be secured to the riser pipe,
the portion of the bucket member, above the bottom member, is generally cylindrical and has vertical grooves opening onto the interior thereof said grooves being upwardly open and terminating in supporting abutments at their lower ends, adjacent the bottom member, and
the bottom member has an outer periphery which is telescopable into and out of the upper end portion of said shell and has lugs projecting from said periphery into said vertical grooves, said lugs engaging the bottoms of said grooves in the assembled position of said bottom member.

28. A containment device as set forth in claim 27 wherein
a circumferential groove is formed on the inner surface of said bucket, above the bottoms of said vertical grooves, and
a snap ring is engaged in said circumferential groove and overlies said bottom member lugs to maintain said bottom member in assembled relation,
said snap ring being manually releasable from said circumferential groove to permit removal of the bottom member.

29. A containment device as set forth in claim 26 wherein
the bucket member comprises
a lower, generally cylindrical portion having vertical grooves opening onto the interior thereof,
an upper generally cylindrical section,
a bottom wall projecting outwardly from said cylindrical section,
a top wall tapered downwardly and outwardly from said upper cylindrical section and connected to said bottom wall to define a spillage container having a relatively large capacity, and
further comprising
a rim mounted on said upper cylindrical section and further wherein
the bottom member has an outer periphery which is insertable into and out of the upper end portion of said shell to be positioned in said cylindrical section and has lugs projecting from said periphery into said vertical grooves, said lugs engaging the bottoms of said grooves in the assembled position of said bottom member.

30. A containment device as set forth in claim 29
a circumferential groove is formed on the inner surface of said lower cylindrical section, above the bottoms of said vertical grooves, and
a snap ring is engaged in said circumferential groove and overlies said bottom member lugs to maintain said bottom member in assembled relation,
said snap ring being manually releasable from said circumferential groove to permit removal of the bottom member.

31. A containment device as set forth in claim 26 further comprising
a riser pipe extension adapted to be mounted on a storage tank riser pipe and comprise the riser pipe means, and
wherein
said flexible member is an upper flexible member releasably clamped to said riser pipe extension, and
further comprising
a lower, flexible member extending between said bottom member and the lower portion of said riser pipe extension and defining, at least in part, a lower chamber beneath said spillage container, and
further characterized in that
the lower flexible member is releasably clamped to the riser pipe extension by means accessible when the bottom member is in its assembled relation,
whereby, the bottom member and the upper and lower flexible members may be removed for repair and/or replacement.

32. A sub-assembly employed in a containment device for preventing soil contamination in filling underground storage tanks of the type having riser pipe means, terminating below ground level, through which fuel flows into the storage tank, said sub-assembly comprising
a riser pipe extension adapted to be mounted on the upper end of a storage tank riser pipe,
a bottom member in the form of planar annulus, having an upstanding annular flange, defining an opening through which the riser pipe extension passes,
an upper, elastomeric, tubular bellows having a lower end sealingly clamped to said upstanding flange and an upper end clamped to the upper portion of the riser pipe extension, and
a lower, elastomeric, tubular bellows having an upper end sealingly clamped to said bottom member and a lower end clamped to the lower portion of the riser pipe extension.

33. A containment device for preventing soil contamination in filling underground storage tanks of the type having riser pipe means, terminating below ground level, through which fuel flows into the storage tank, said device comprising
bucket means comprising a vertically disposed shell,
bottom forming means defining an upwardly open, spillage container in combination with the bucket means,
means for attaching the bottom forming means to the riser pipe means of a storage tank,
means permitting relative movement between the upper end of the bucket means and said attaching means,
characterized by
adjustable means for establishing the relative relationship between the upper end of said bucket and said attaching means, and
further characterized in that
said means for establishing the relationship between the upper end of the bucket means and the attaching means are disengageable,
whereby, the bottom forming member may be attached to the riser pipe means; the top of the bucket means brought to a desired position; the top of the bucket secured in place in the installation process, and then the adjusting means disengaged to permit relative movement to occur as may be occasioned by natural forces.

34. A containment device as set forth in claim 33 further characterized in that the adjustable means can selectively adjust the height of the attaching means relative to the top of the bucket means and the angular relationship therebetween.

35. A containment device as set forth in claim 34 wherein the bottom forming means is secured in fixed relation to the bucket means and the means permitting relative movement permit movement between the bottom forming means and the attaching means.

36. A containment device as set forth in claim 33 wherein the adjustable means are effective between the bucket means and the riser pipe means.

37. A containment device as set forth in claim 36 wherein the adjustable means comprises a nut threaded onto the upper end of the riser pipe means said nut having an internal threaded portion, a vertical adjusting screw threaded into said internal threaded portion, plate means carried by said adjusting screw and engaged with said bucket member, whereby rotation of the adjusting screw will establish a desired relative height of the bucket means.

38. A containment device as set forth in claim 37 further comprising a riser pipe extension having a generally vertical axis, adapted to mounted on a storage tank riser, comprises the riser pipe means, and further wherein the bucket means comprise a cylindrical section having a vertical axis offset from the vertical axis of the riser pipe extension, a circumferential groove is formed in said cylindrical section and engaged by said plate means, and the plate means is rotatable relative to the adjusting screw and said bucket means to thereby establish a desired angular relation between the upper end of the bucket means and the riser pipe extension.

39. A containment device as set forth in claim 33 wherein the bottom forming means comprise a bottom member having a central opening through which the riser pipe means extend, said bottom member being secured in fixed relation to the shell of the bucket means, the means permitting relative movement comprise a flexible member extending between the bottom member and the attaching means, and the adjusting means comprise a plate mounted on said riser pipe means, above said bottom member, a plurality of vertical arms mounted on the bottom member and means for providing an adjustable connection between said arms and said plate.

40. A containment device as set forth in claim 39 wherein there are three vertical arms, and the means comprising an adjustable connection comprise notch means providing engagement between said plate and said vertical arms, said notch means being selectively engageable to provide for establishment of a desired heightwise and angular relation between the bottom member and bucket member, relative to said riser pipe extension.

41. A containment device for preventing soil contamination in filling underground storage tanks of the type having riser pipe means, terminating below ground level, through which fuel flows into the storage tank, said device comprising means forming an upwardly open, spillage container including, at the upper end thereof, a shell of generally circular outline, and an annular rim telescoped over and mounted on said shell, characterized in that the shell has L-shaped grooves which are open at the upper end of the shell, the rim has inwardly projecting lugs which are receivable in said L-shaped slots, permitting the rim to be telescoped over and then rotated with respect to said shell to bring said lugs into the horizontal portions of said L-shaped slots, thereby locking the rim thereon.

42. A containment device as set forth in claim 41 further comprising clips secured to upper end of the shell and, respectively, engaged in the vertical portions of said L-shaped grooves and preventing rotation of the rim to a position in which said lugs would be brought into alignment with the vertical portions of the grooves.

43. A containment device for preventing soil contamination in filling underground storage tanks of the type having riser pipe means, terminating below ground level, through which fuel flows into the storage tank, said device comprising an upwardly open container having a generally circular shell at its upper end, an annular rim projecting outwardly from the upper end of said container, and a lid mounted on said rim and closing the opening into said container, characterized in that the upper surface of said rim is spaced beneath the upper end of said circular shell and is angled downwardly towards its outer periphery, an annular rib projects upwardly from said upper surface, and the lid has a peripheral lip which engages the upper surface of the rim outwardly of said rib and supports the lid thereon.

44. A containment device as set forth in claim 43 wherein the circular shell has an outwardly projecting shoulder providing support for said rim and aligning it at right angles to the shell, and further comprising a sealing ring disposed between said shoulder and said rim.

45. A containment device as set forth in claim 44 wherein the shell further comprises a lower cylindrical section defining the outer bounds of said shoulder, and the rim comprises a depending flange telescoped over the lower cylindrical section and aligned thereby.

46. A containment device for preventing soil contamination in filling underground storage tanks of the type having riser pipe means, terminating below ground level, through which fuel flows into the storage tank, said device comprising an upwardly open spillage container having a generally circular shell at its upper end, an annular rim projecting outwardly from the upper end of said container, and a plurality of anchors, mounted on said rim, for insuring a firm attachment between the containment device and a concrete apron, each anchor being formed of metal wire and comprising a pair of downwardly angled legs connected by a central coil.

47. A containment device as set forth in claim 46 wherein the rim has lugs disposed beneath its upper surface and the anchors are, respectively, mounted on said lugs, the coil of each lug being expanded to yielding grip the lug on which it is mounted.

48. A containment device for preventing soil contamination in filling underground storage tanks of the type having riser pipe means, terminating below ground level, through which fuel, or other potentially hazardous liquid, flows into a storage tank, said device comprising a bucket member in the form of a vertically disposed shell, a riser pipe extension adapted to be mounted on a storage tank riser pipe and comprise the riser pipe means, an elastomeric separating member having an intermediate portion, the outer perimeter of which is secured in sealed relation to the interior peripheral surface of said bucket member and an upper, tubular bellows section having an upper end clamped to the riser pipe extension, said bucket member, said intermediate portion and said upper bellows section forming an upwardly open, spillage container, said separating member also comprising a lower tubular section having a lower end clamped to the riser pipe extension, said intermediate portion and said lower tubular portion forming a lower chamber beneath the spillage container.

49. A containment device as set forth in claim 48 further comprising a valve controlled passage for draining fuel from the spillage container to said lower chamber, and openings in said riser pipe extension for draining fuel from the lower chamber into the storage tank.

50. A containment device as set forth in claim 49 wherein an annular support plate overlies the intermediate portion of the separating member, the upper end of the bellows portion is releasably clamped to the riser pipe extension, the lower end of the lower bellows portion is releasable clamped to the riser pipe extension, accessible when the clamp for the upper end of the upper bellows portion is release, and the intermediate portion of the separating member is releasably clamped to the bucket member, whereby, the separating member can be removed from the bucket member for repair and/or replacement.

51. A method of installing a containment device on a riser pipe means projecting upwardly from an underground storage tank, where the containment device comprises a bucket member which is open at its lower end and bellows means are disposed in the lower end of the bucket member to accommodate relative movement between the bucket member and the riser means, and wherein the method includes the step of backfilling an excavation in which the containment device is disposed, characterized by the step of securing an open ended bag, at one end, to the lower end of the bucket member and securing the bag, at the other end thereof, to the riser pipe means, said securing step being performed prior to backfilling to thereby protect the bellows means from backfill material.

52. A method as in claim 51 including the further steps of forming a circumferential groove in the outer surface of the bucket member, adjacent its lower end, and securing said one end of said bag in said groove.

53. A method as in claim 52 wherein the step of securing said one end of said bag includes wrapping a wire around said bag and twisting the ends thereof to secure the one end of the bag in place.

54. A containment device for preventing soil contamination in filling underground storage tanks of the type having riser pipe means, terminating below ground level, through which fuel flows into the storage tank, said tank being mounted in an excavation which is backfilled to the level of the containment device, said device comprising means for mounting the containment device on the riser pipe means.

a bucket member which is open at its lower end and bellows means, disposed in the lower end of the bucket member, for connecting the bucket member and the mounting means to accommodate relative movement between the bucket member and the riser means, characterized by a circumferential groove in the outer surface of the bucket member, adjacent its lower end, thereby providing means for facilitating attachment of the upper end of an open ended bag to the bucket member, the lower end of said bag being secured to the riser pipe means, to thereby prevent damage to the bellows means when the excavation for the storage tank is backfilled.

55. A containment device as in claim 54 further characterized in that the lower end of the bucket member is tapered inwardly, and said groove is formed in the tapered portion.

* * * * *